US008991806B2

(12) United States Patent
Meyer

(10) Patent No.: US 8,991,806 B2
(45) Date of Patent: Mar. 31, 2015

(54) EXTENSION TABLE ASSEMBLY FOR POWER TOOLS

(76) Inventor: John Matthew Meyer, Sun Valley, ID (US)

( * ) Notice: Subject to any disclaimer, the term of this patent is extended or adjusted under 35 U.S.C. 154(b) by 217 days.

(21) Appl. No.: 13/588,116

(22) Filed: Aug. 17, 2012

(65) Prior Publication Data

US 2013/0277905 A1 Oct. 24, 2013

Related U.S. Application Data

(60) Provisional application No. 61/635,387, filed on Apr. 19, 2012.

(51) Int. Cl.

| | |
|---|---|
| ***B23Q 3/00*** | (2006.01) |
| ***B23D 25/00*** | (2006.01) |
| ***B26D 7/06*** | (2006.01) |
| ***A47B 11/00*** | (2006.01) |
| ***B25H 1/06*** | (2006.01) |
| *B25H 1/02* | (2006.01) |

(52) U.S. Cl.

CPC ..... *B25H 1/06* (2013.01)
USPC ..... 269/304; 144/286.1; 144/287; 83/437.1; 108/143

(58) Field of Classification Search

USPC ..... 269/304; 144/286.1, 286.5, 287; 83/437.1, 477.2; 108/143
See application file for complete search history.

(56) References Cited

U.S. PATENT DOCUMENTS

| | | | | |
|---|---|---|---|---|
| 741,479 | A | 10/1903 | Fry | |
| 2,485,274 | A | 10/1949 | Garrett | |
| 2,747,625 | A | 5/1956 | Small | |
| 2,852,049 | A | 9/1958 | Peterson | |
| 3,910,142 | A | 10/1975 | Jureit et al. | |
| 4,341,247 | A | 7/1982 | Price | |
| 4,798,113 | A | 1/1989 | Viazanko | |
| 4,873,700 | A | 10/1989 | Lutmer et al. | |
| 4,873,770 | A | 10/1989 | Luttmer et al. | |
| 4,961,269 | A | 10/1990 | Luttmer et al. | |
| 4,982,509 | A | 1/1991 | Luttmer et al. | |
| 5,092,058 | A | 3/1992 | Luttmer et al. | |
| 5,105,862 | A | 4/1992 | Skinner et al. | |
| 5,201,863 | A * | 4/1993 | Peot | 83/432 |
| 5,320,150 | A | 6/1994 | Everts et al. | |

(Continued)

FOREIGN PATENT DOCUMENTS

| | | | | |
|---|---|---|---|---|
| CA | 2507838 | A1 * | 9/2006 | |
| DE | 3706899 | A1 * | 9/1988 | B25F 5/00 |

(Continued)

OTHER PUBLICATIONS

Dewalt Miter Saw Stand Model DW723, printed from http://www.dewalt.com/tools/machinery-miter-saw-workstations-dw723.aspx on Apr. 17, 2012.

(Continued)

*Primary Examiner* — Lee D Wilson
*Assistant Examiner* — Alvin Grant
(74) *Attorney, Agent, or Firm* — Buchanan Nipper

(57) ABSTRACT

An extension table assembly for a power tool having a working surface for supporting a piece of material to be modified, and a working area where the power tool can modify a piece of material. The extension table assembly comprising a frame portion, at least one arm portion, a drive system, and a measurement system.

20 Claims, 16 Drawing Sheets

(56) References Cited

U.S. PATENT DOCUMENTS

| | | | | |
|---|---|---|---|---|
| 5,327,653 | A | 7/1994 | Pistorius et al. | |
| 5,417,307 | A * | 5/1995 | McIntyre et al. | 182/181.1 |
| 5,526,856 | A | 6/1996 | Pedri | |
| 5,592,981 | A | 1/1997 | Derecktor | |
| 5,735,324 | A | 4/1998 | Ponce | |
| 5,836,365 | A | 11/1998 | Derecktor | |
| 6,189,429 | B1 * | 2/2001 | Liu | 83/477 |
| 6,347,592 | B1 * | 2/2002 | Gessert | 108/157.16 |
| 6,508,281 | B1 * | 1/2003 | Wang | 144/287 |
| 6,672,348 | B2 | 1/2004 | Ransom et al. | |
| 6,684,519 | B1 | 2/2004 | McAllisterr | |
| 6,880,442 | B2 | 4/2005 | Duginske | |
| 6,899,006 | B2 | 5/2005 | Jolkovski | |
| 7,231,858 | B2 | 6/2007 | Oberheim | |
| 7,240,705 | B2 | 7/2007 | Alger | |
| 7,240,706 | B2 * | 7/2007 | Liu et al. | 144/286.5 |
| 7,346,847 | B2 | 3/2008 | Etter et al. | |
| 7,350,444 | B2 * | 4/2008 | Gass et al. | 83/58 |
| 7,359,762 | B2 | 4/2008 | Etter et al. | |
| 7,373,961 | B2 * | 5/2008 | Liu et al. | 144/286.1 |
| D571,121 | S | 6/2008 | Radermacher | |
| 7,438,098 | B2 * | 10/2008 | Liu et al. | 144/286.5 |
| 7,458,403 | B2 | 12/2008 | Radermacher | |
| 7,481,254 | B2 | 1/2009 | Welsh et al. | |
| 7,483,765 | B2 | 1/2009 | Dick et al. | |
| 7,490,643 | B2 * | 2/2009 | Liu et al. | 144/286.5 |
| 7,530,377 | B2 | 5/2009 | Ayala et al. | |
| 7,614,330 | B2 | 11/2009 | Griswold et al. | |
| 7,640,676 | B1 | 1/2010 | Poole | |
| 7,792,602 | B2 * | 9/2010 | Dick | 700/180 |
| 7,798,187 | B1 | 9/2010 | Duginske | |
| 8,004,664 | B2 | 8/2011 | Etter et al. | |
| 2003/0140985 | A1 * | 7/2003 | Wang | 144/287 |
| 2004/0250901 | A1 * | 12/2004 | Ursell et al. | 144/286.1 |
| 2005/0051012 | A1 | 3/2005 | Jolkovski | |
| 2006/0213579 | A1 * | 9/2006 | Liu et al. | 144/287 |
| 2007/0157782 | A1 | 7/2007 | Hetcher et al. | |
| 2007/0284017 | A1 * | 12/2007 | Liu et al. | 144/286.5 |
| 2008/0203704 | A1 * | 8/2008 | McCracken et al. | 280/651 |
| 2009/0121405 | A1 * | 5/2009 | Brown et al. | 269/216 |
| 2010/0064869 | A1 | 3/2010 | Poole | |
| 2011/0056344 | A1 | 3/2011 | Dick et al. | |

FOREIGN PATENT DOCUMENTS

| | | | | |
|---|---|---|---|---|
| GB | 2132546 | A * | 7/1984 | B25H 1/10 |
| WO | 2010144630 | | 12/2010 | |

OTHER PUBLICATIONS

Dewalt Model DWX723 Heavy Duty Miter Saw Stand printed from http://www.dewalt.com/tools/machinery-miter-saw-workstations-dwx723.aspx on Apr. 17, 2012.

Dewalt Model DWX725B Heavy Duty Work Stand with Miter Saw Mounting Brackets printed from http://www.dewalt.com/tools/machinery-miter-saw-workstations-dwx725b.aspx on Apr. 17, 2012.

Dewalt Model DWX724 Compact Miter Saw Stand printed from http://www.dewalt.com/tools/machinery-miter-saw-workstations-dwx724.aspx on Apr. 17, 2012.

Rigid Model AC9945 Miter Saw Utility Vehicle printed from http://www.ridgid.com/Tools/AC9945-Miter-Saw-Utility-Vehicle on Apr. 17, 2012.

Rigid Model AC9944 Miter Saw Utility Vehicle printed from http://www.ridgid.com/tools/ac9944-miter-saw-utility-vehicle/en/index.htm on Apr. 17, 2012.

Ryobi Miter Saw Quickstand Model A18MS01 printed from http://www.ryobitools.com/catalog/accessories/standtables/A18MS01 on Apr. 17, 2012.

Bosch Model GTA3800 Folding Leg Miter Saw Stand printed from http://www.boschtools.com/Products/Tools/Pages/BoschProductDetail.aspx?pid=GTA3800 on Apr. 17, 2012.

SawGear Brochure, downloaded from http://www.sawgear.com/Portals/0/Documents/SawGear-Brochure-FINAL-web.pdf, downloaded about Jul. 13, 2012.

* cited by examiner

EXTENSION TABLE ASSEMBLY FOR POWER TOOLS

PRIORITY/CROSS-REFERENCE TO RELATED APPLICATIONS

This application claims the benefit of U.S. Provisional Application No. 61/635,387, filed 19 Apr. 2012, the disclosure of which is incorporated by reference.

TECHNICAL FIELD

The disclosure generally relates to the field of power tools. Particular embodiments relate to table assemblies for power tools.

BACKGROUND

Power tools are typically used in a workshop, mounted on a workbench. Oftentimes, such power tools are needed to be used at a remote location, such as a jobsite. When used at such a jobsite, the power tool is either placed on a support surface, mounted on a portable workbench (table assembly).

SUMMARY OF THE DISCLOSURE

Several exemplary extension table assemblies for power tools are described herein. Such power tools having a working surface for supporting a piece of material to be modified. Such power tools also having a working area where the power tool can modify (e.g., cut) a piece of material.

An exemplary extension table assembly comprises a frame portion, an arm portion, at least one drive system, and a measurement system. The frame portion for supporting the power tool above a surface. The frame portion comprising at least one power tool mount configured for mounting the power tool there-on. The frame portion comprising at least one surface support for supporting the frame portion above a surface, and at least one connector for connecting the frame portion to the arm portion. The arm portion comprising a distal end and a proximal end. The distal and proximal ends defining an arm portion length there-between. The proximal end connects with the frame portion at the connector. The arm portion further comprising a support surface for supporting the piece of material to be modified. It is preferred that the support surface be generally planar to the working surface. The drive system comprising a movable carriage and a shuttle having an end stop. The measurement system for computing the distance between the end stop and the working area to determine a material length.

Another exemplary extension table assembly for a power tool comprises a working surface for supporting a piece of material to be modified, and a working area where the power tool can modify (e.g., cut) a piece of material. The exemplary extension table assembly for a power tool comprising a frame portion, an arm portion, at least one drive system, and a measurement system. The frame portion comprising at least one power tool mount. The power tool mount configured for mounting the power tool there-on. The frame portion comprising at least one surface support for supporting the frame portion above a surface. The frame portion comprising at least one connector for connecting the frame portion to the arm portion. The arm portion comprising a distal end and a proximal end defining an arm portion length therebetween, wherein the proximal end connects with frame portion at the connector. The arm portion further comprising a support surface for supporting the piece of material to be modified, the support surface generally planar to the working surface. The drive system comprising a movable carriage and a shuttle having an end stop, wherein the drive system further comprises a drive for driving the movable carriage along the rail. The measurement system comprises a sensor for sensing the relative position of the end stop relative to the working area and generating an end stop signal. The measurement system further comprises a microprocessor and an alpha-numeric display device. The microprocessor receives the end stop signal from the sensor. The microprocessor determines the distance from the end stop to the working area thereby computing the material length. The microprocessor outputs a length signal corresponding to the material length. The alpha-numeric display device receives the length signal from the microprocessor and provides an alpha-numeric representation of the material length.

Another exemplary extension table assembly comprises a frame portion, an arm portion, at least one drive system, and a measurement system. The frame portion comprising at least one power tool mount. The power tool mount configured for mounting the power tool there-on. The frame portion comprising at least one surface support for supporting the frame portion above a surface. The frame portion comprising at least one connector for connecting the frame portion to the arm portion. The arm portion comprising a distal end and a proximal end defining an arm portion length therebetween, wherein the proximal end connects with frame portion at the connector. The arm portion further comprising a support surface for supporting the piece of material to be modified, the support surface generally planar to the working surface, wherein a first guide channel is defined along the arm portion length, the first guide channel comprising a first rail, the movable carriage configured for moving along the first rail. The extension arm portion having a first end opposite a second end defining an extension arm portion length therebetween, the first end attaching to the distal end via an arm connector, the extension arm portion further comprises a second surface support for supporting the extension arm portion above the surface, the second surface support comprising a plurality of legs, wherein the legs are configured for extending between an extended position and a retracted position, wherein a second guide channel is defined along the extension arm portion length, the second guide channel comprising a second rail, the movable carriage configured for moving along the second rail, the second guide channel aligned with the first guide channel when the arm portion and the extension arm portion are in their use position, wherein the extension arm portion further comprising a second support surface for supporting the piece of material to be modified, the second support surface generally planar to the support surface when the arm portion and the extension arm portion are in their use position. The arm portion and the extension arm portion have a use position and a stowed position, wherein the arm connector comprises a hinge portion for hingedly connecting the extension arm portion to the arm portion, wherein the arm portion and the extension arm portion each comprises an underside surface, wherein in the stowed position the arm portion and the extension arm portion are folded together so that the underside surfaces face one another. The drive system comprising a movable carriage having an end stop, wherein the drive system further comprises a drive for driving the movable carriage along rail, wherein the drive comprises: a drive pulley on a drive shaft, a second pulley on a second shaft, a hand-wheel for turning the drive shaft, and a belt extending between the drive pulley and the second pulley, wherein the movable carriage is attached to the belt, wherein rotation of the hand-wheel in a first direction causes the movable carriage to advance along the rail in a first direction, and wherein rotation of the hand-wheel in a second direction causes the movable carriage to advance along the rail in a second direction. The measurement system comprises a rotary encoder on the drive shaft, the rotary encoder for sensing the relative position of the end stop relative to the working area and generating an end stop signal, wherein the measurement system further comprises a microprocessor and an alpha-numeric display device, wherein the microprocessor receives the end stop signal from the rotary encoder, wherein the microprocessor determines the distance from the end stop to the working area thereby computing the material length, wherein the microprocessor outputs a length signal corresponding to the material length, wherein the alpha-numeric display device receives the length signal from the microprocessor and provides an alpha-numeric representation of the material length.

Additional understanding of the devices contemplated and/or claimed by the inventor can be gained by reviewing the detailed description of exemplary devices and methods, presented below, and the referenced drawings.

BRIEF DESCRIPTION OF THE DRAWINGS

FIG. 3 is a top plan view of the extension table assembly of FIG. 1, illustrated without the power tool attached there-to.

FIG. 4 is a side view of the extension table assembly of FIG. 1, illustrated without the power tool attached there-to.

FIG. 7 is a partial, perspective view of a portion of the extension table assembly of FIG. 1, illustrated without the power tool attached there-to.

FIG. 8 is a partial, perspective view of a portion of the extension table assembly of FIG. 1, illustrated without the power tool attached there-to.

FIG. 12 is a first, perspective sequential view of the extension table assembly of FIG. 1 being folded into its stowed position, illustrated without the power tool attached there-to.

FIG. 13 is a second, perspective sequential view of the extension table assembly of FIG. 1 being folded into its stowed position, illustrated without the power tool attached there-to.

FIG. 14 is a third, perspective sequential view of the extension table assembly of FIG. 1 being folded into its stowed position, illustrated without the power tool attached there-to.

FIG. 15 is a fourth, perspective sequential view of the extension table assembly of FIG. 1 being folded into its stowed position, illustrated without the power tool attached there-to.

FIG. 17 is a partial, perspective view of the extension table assembly of FIG. 1 shown folded into its stowed position, illustrated without the power tool attached there-to.

DETAILED DESCRIPTION

Figure 1:
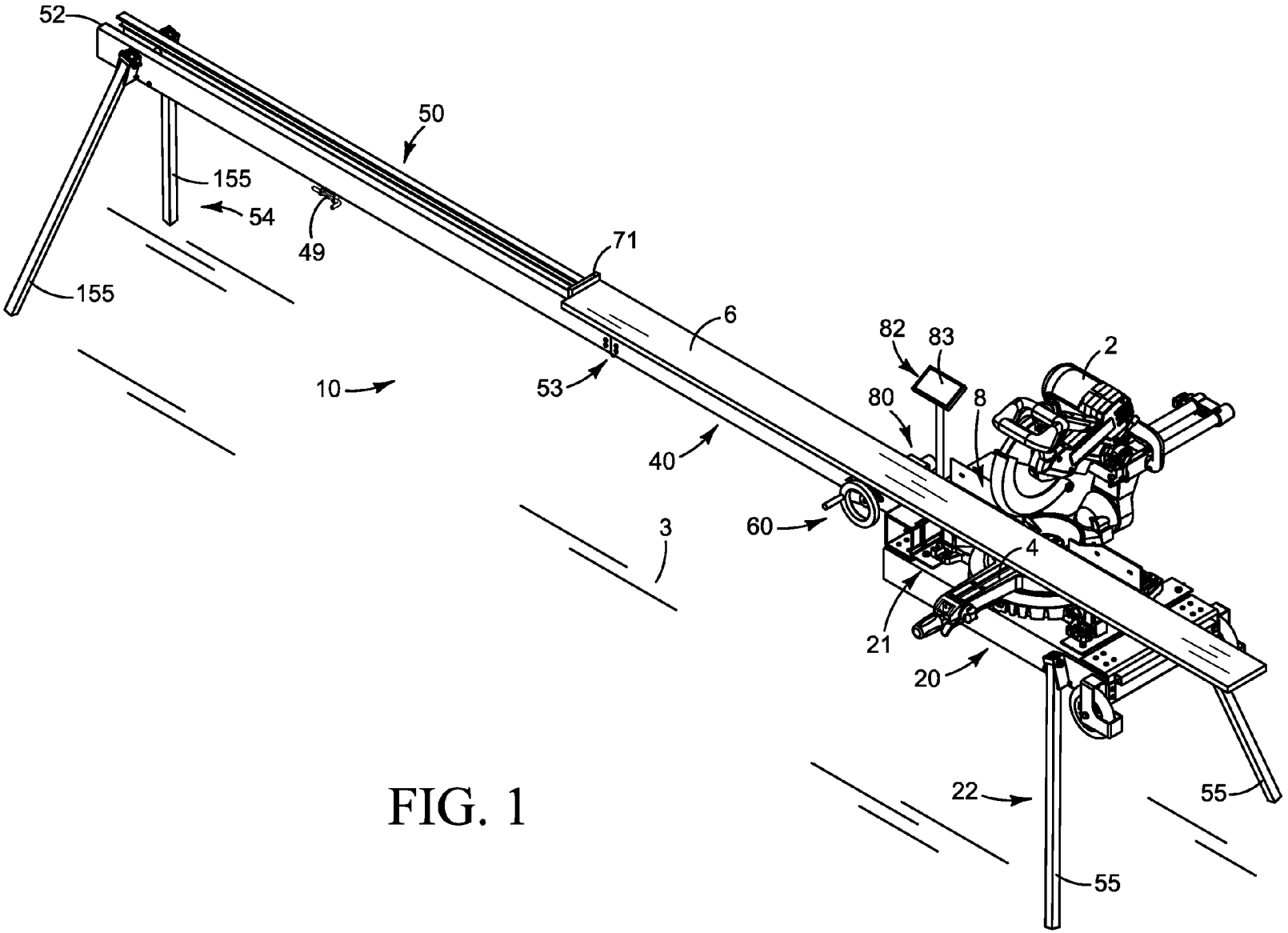
FIG. 1 is a perspective representational view of a first exemplary extension table assembly, illustrated with a power tool attached thereto.
Figure 2:
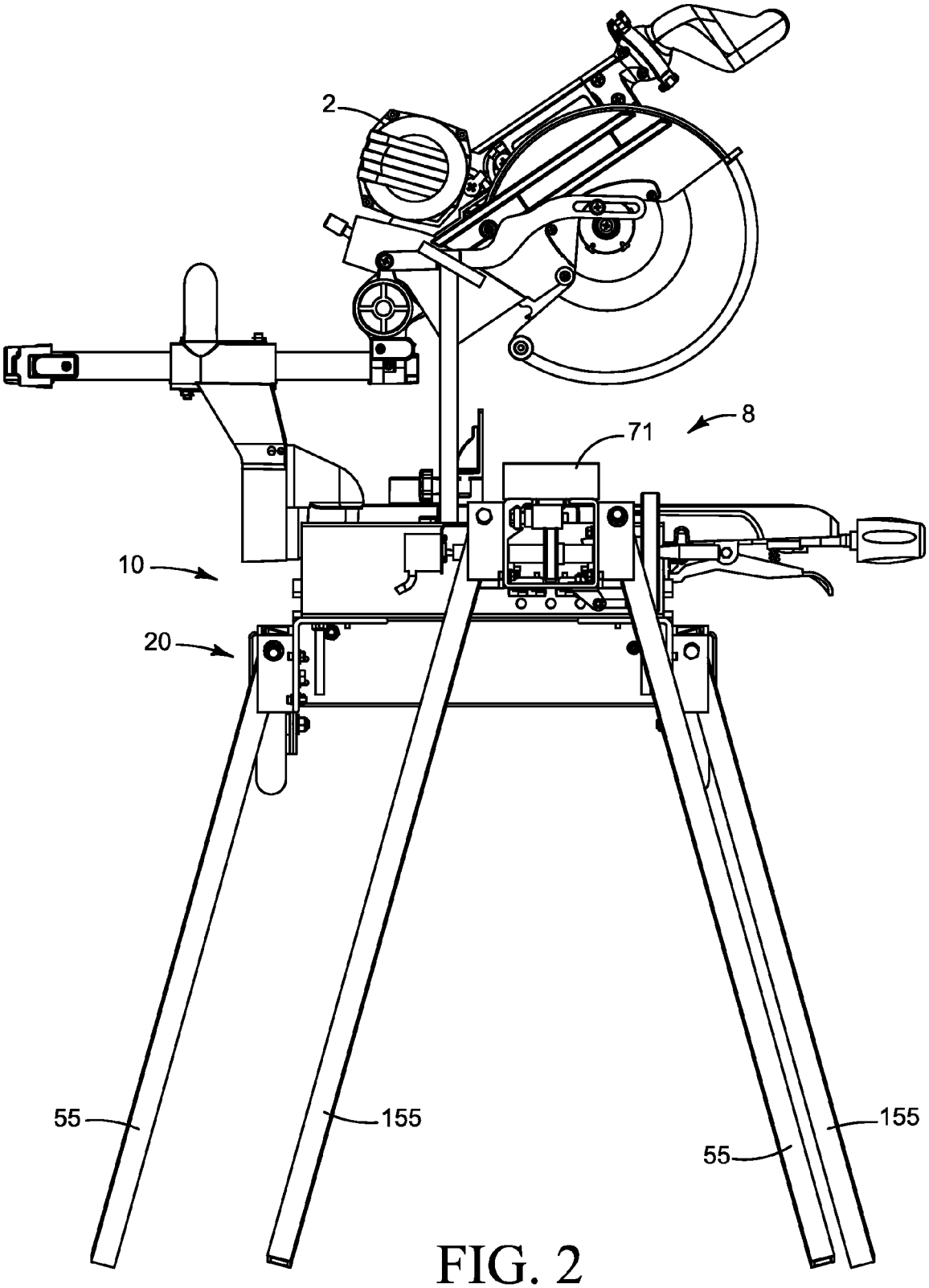
FIG. 2 is a first end view of the extension table assembly of FIG. 1.

The following description and the referenced drawings provide illustrative examples of that which the inventor regards as his invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," "for example," and "or" and grammatically related terms indicates non-exclusive alternatives without limitation, unless otherwise noted. The use of "including" and grammatically related terms means "including, but not limited to," unless otherwise noted. The use of the articles "a," "an" and "the" are meant to be interpreted as referring to the singular as well as the plural, unless the context clearly dictates otherwise. Thus, for example, reference to "a belt" includes two or more such belts, and the like. The use of "optionally," "alternatively," and grammatically related terms means that the subsequently described element, event or circumstance may or may not be present/occur, and that the description includes instances where said element, event or circumstance occurs and instances where it does not. The use of "preferred," "preferably," and grammatically related terms means that a specified element or technique is more acceptable than another, but not that such specified element or technique is a necessity, unless the context clearly dictates otherwise. The use of "exemplary" means "an example of" and is not intended to convey a meaning of an ideal or preferred embodiment.

The use of "power tool" means "a tool that is actuated by an additional power source and mechanism other than the solely manual labor used with hand tools," unless the context clearly dictates otherwise. Examples of power tools include, but are not limited to, saws (e.g., chop saws, miter saws, cut-off saws, band saws, radial arm saws, scroll saws, table saws), shears, grinders, sanders, jointers, planers, trimmers, drills, tile cutters, and routers.

The use of "material" means "the material the power tool modifies (e.g., cuts, melts, crimps, drills)," unless the context clearly dictates otherwise. Examples of material include, but are not limited to, dimensional lumber, pipe, tubing, wire, and structural steel (e.g., beams, angle iron, channel, rods, bars, plate).

The use of "working area" mean "the location where the power tool modifies the material," unless the context clearly dictates otherwise. Examples of working areas include, but are not limited to, the plane of cut of a saw, and the point where a drill bit engages material.

A first embodiment of the inventive concept(s) is illustrated in FIGS. 1 through 19. The first illustrated embodiment comprising an extension table assembly 10 for a power tool 2. The power tool 2 having a working surface 4 for supporting a piece of material 6 to be modified, and a working area 8 where the power tool 2 can modify the piece of material 6, for instance by cutting. In an exemplary embodiment, the piece of material comprises a piece of dimensional lumber, the power tool comprises a miter saw, the working surface comprises the surface of the miter saw utilized to support piece of dimensional lumber during cutting, and the working area comprises the plane of cut for the miter saw.

The first exemplary extension table assembly 10 comprises a frame portion 20 for supporting the power tool 2 above a surface 3, an arm portion 40, at least one drive system 60, and a measurement system 80. Optionally, an extension arm portion 50 is provided.

The frame portion 20 comprising at least one power tool mount 21. The power tool mount 21 particularly illustrated in FIGS. 3, 4, and 17. The power tool mount 21 configured for allowing the power tool 2 to be mounted onto the frame portion 20. It is preferred that this connection be temporary so that the power tool 2 can be easily removed from the frame portion 20, but in other embodiments the power tool 2 may be more fixedly attached to the frame portion 20, for instance via bolts.

In the first exemplary extension table assembly 10, the power tool mount 21 comprises a left support 121 and a right support 122 which allow the power tool 2 to be easily connected to and disconnected from the frame portion 20. For illustrative purposes, FIG. 17 does not illustrate the power tool connected to either the left support 121, or the right support 122. The left support 121 and/or the right support 122 can be configured for attachment to the bottom of the power tool 2, or the frame portion 20, through a suitable connection, for instance a plurality of bolts. For instance, in one connection, the left support 121 and right support 122 are configured for attachment to the bottom of the power tool 2. In a second connection, the left support 121 is configured for attachment to the bottom of the power tool 2, whereas the right support 122 is configured for attachment to the frame 20 such that the tool 2 when in place rests on right support 122. In a third connection, the right support 122 is configured for attachment to the bottom of the power tool 2, whereas the left support 121 is configured for attachment to the frame 20 such that the tool 2 when in place rests on left support 121. In a fourth connection, the left support 121 and the right support 122 are configured for attachment to the frame 20 such that the tool 2 when in place rests on the left and right supports. The variance in configuration is at the operators preference, and the type of, or lack of, connection to the frame 20 will determine if holes, welds, or other modifications to left support 121 or right support 122 are present, and a skilled artisan will be able to select an appropriate structure in a particular embodiment based on various considerations, including the intended use of the extension table assembly, the intended arena within which the extension table assembly will be used, and the equipment and/or accessories with which the extension table assembly is intended to be used, among other considerations.

It is preferred that the power tool mount 21 be fixed in location relative to the frame portion 20 and the arm portion 40. In such a configuration, the frame portion 20 and power tool mount 21 are located at a first end of the extension table assembly 10 with the arm portion 40 and extension arm portion 50 (if present) extending away there-from.

In the power tool mount 21 illustrated with the first exemplary extension table assembly 10, the left support 121 further comprises at least one connector for allowing the power tool mount 21 to be connected to the frame portion 20. While the first extension table assembly 10 illustrates this as a lateral connection, other orientations of connections are also envisioned.

In the first exemplary extension table assembly 10, provided are two lateral connectors, namely a proximal lateral connector 123 and a distal lateral connector 124. The lateral connectors (123, 124) comprising heads (125, 126) configured for sliding into channels (127, 128) defined in the frame portion 20, thereby laterally connecting the power tool mount 21 to the frame portion 20. In such a configuration, the power tool mount 21 can rest upon the frame portion 20. Other manners of attaching the power tool to the extension table assembly are also envisioned. The lateral connectors can be adjustable for allowing a user to better fix the power tool to the extension table assembly once attached, for instance through the tightening of one or more bolts.

In such a configuration, where the left support 121 is attached to the bottom of the power tool 2, a user desiring to remove the power tool from the extension table assembly merely needs to lift upwards on the power tool 2 to disengage the lateral connectors (123, 124) from their connection with the channels (127, 128), thereby enabling the user to remove the power tool 2 from the extension table assembly 10. To connect the power tool 2 to the extension table assembly 10, the reverse process utilized, with the power tool 2 set onto the extension table assembly 10 with the lateral connectors (123, 124) engaging the channels (127, 128).

Figure 3:
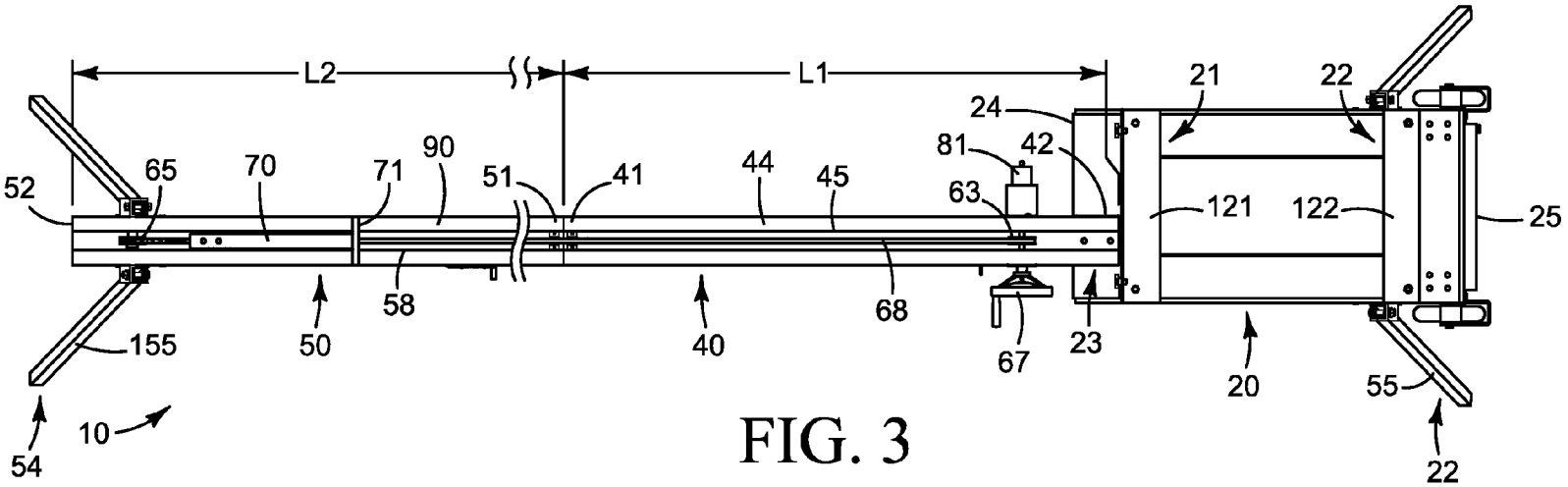
Figure 4:
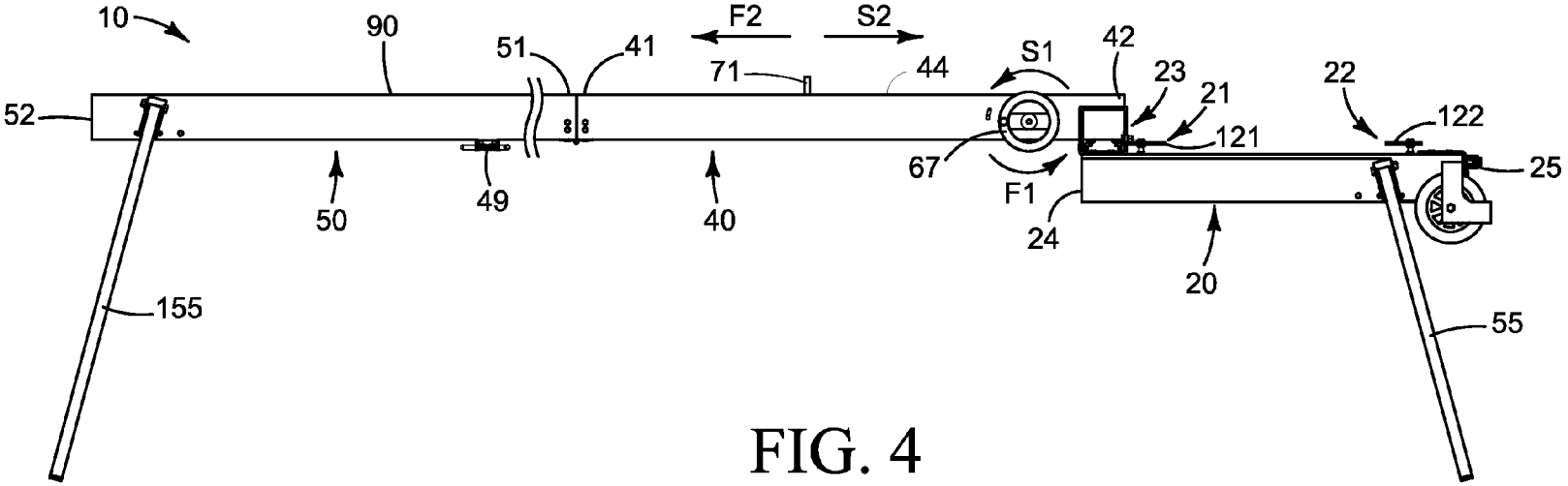

Referring now to FIGS. 3 and 4, in the first exemplary extension table assembly 10, the frame portion 20 comprises a first side 24 opposite a second side 25. The frame portion 20 comprising at least one connector 23 for connecting the frame portion 20 to the arm portion 40. The connector 23 attaching the arm portion 40 to the frame portion 20 so that the arm portion 40 generally extends away from the first side 24.

In the first exemplary extension table assembly 10, the connector 23 comprising the bolting of the proximal end 42 of the arm portion 40 to the first side 24 of the frame portion 20. Other types of connectors could be used for connecting these two components together, and a skilled artisan will be able to select an appropriate structure and material for the connector and connection in a particular embodiment based on various considerations, including the intended use of the extension table assembly, the intended arena within which the extension table assembly will be used, and the equipment and/or accessories with which the extension table assembly is intended to be used, among other considerations.

The arm portion 40 further comprises a support surface 44, and the extension arm portion 50 further comprises a second support surface 90. The support surface 44 and the second support surface 90 for supporting a piece of material 6 to be modified. It is preferred that the second support surface 90 be generally planar to the support surface 44 when the arm portion 40 and the extension arm portion 50 are in their use position (described below). It is further preferred that the working surface 4 of the power tool 2 be generally planar with the support surface 44 of the arm portion (and second support surface 90 of the extension arm portion 50, when present and in their use position).

Figure 17:
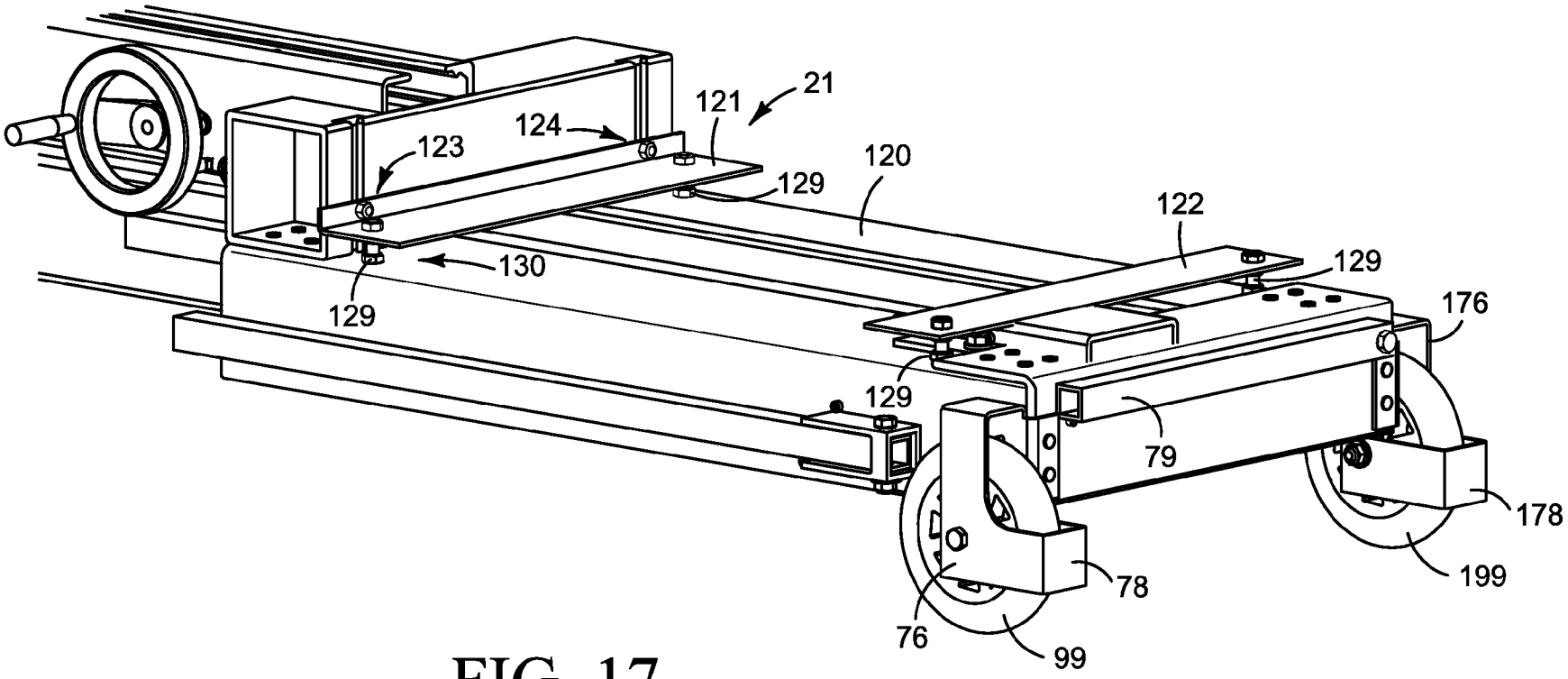

Depending upon the particular make and model of power tool 2 used, the height of the working surface 4 relative to the support surface 44 may need to be adjusted through use of a horizontal adjustment device. One exemplary horizontal adjustment device 130 is illustrated in FIG. 17. The horizontal adjustment device 130 for allowing the height of the working surface 4, relative to the support surface 44, to be adjusted upwards or downwards as necessary to make the working surface 4 generally level with the support surface 44. In the first exemplary extension table assembly, the horizontal adjustment device 130 comprises a plurality of adjustable risers 129.

In the first extension table assembly 10, the adjustable risers 129 extend downwards from the left support 121 and right support 122 of the power tool mount 21 for contacting a base surface 120 of the frame portion 20. Alternatively, the adjustable risers could extend upwards from the base surface 120 of the frame portion 20 for contacting the under side of the power tool and/or the under side of the power tool mount 21. Horizontal adjustment can be accomplished through any number of mechanical apparatuses, including, but not limited to, bolts, pins, rods, and bumpers. Such mechanical apparatuses may be fixed in height and/or may be adjustable, for instance, by the turning of a bolt head to adjust height. Other types of horizontal adjustment devices include, but are not limited to, spacers and/or spacer plates.

As illustrated particularly in FIGS. 1 through 4, the frame portion 20 comprising at least one surface support 22 for supporting the frame portion 20 above a surface 3. In the first exemplary extension table assembly 10, the surface support 22 comprising a pair of legs 55 extending from the frame portion 20. A second pair of legs 155 are illustrated extending from the second end 52 of the extension arm portion 50. In embodiments not comprising an extension arm portion, as a second surface support 54, a pair of legs (not illustrated) could extend from the arm portion 40 or from another location instead of the presence of the second pair of legs 155.

In the first exemplary extension table assembly 10, the legs (55, 155) are configured for extending between an extended position (use) and a retracted position (stowed). FIG. 1 illustrates the extended leg position, whereas FIGS. 14, 15, 17, 18 and 20 illustrate the retracted leg position.

Figure 18:
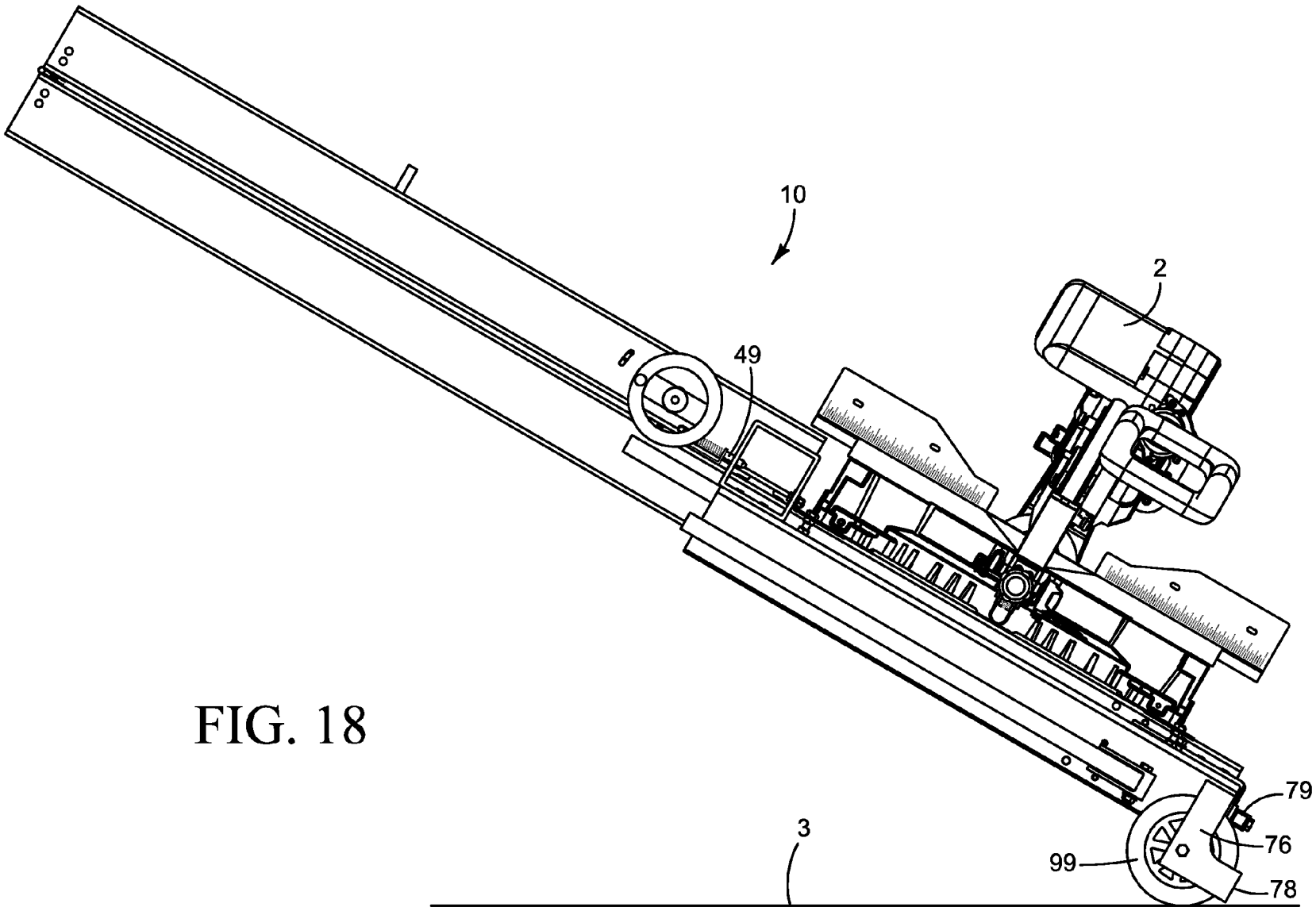
FIG. 18 is a side view of the extension table assembly of FIG. 1 shown folded into its stowed position, moved into a towed mode.
Figure 19:
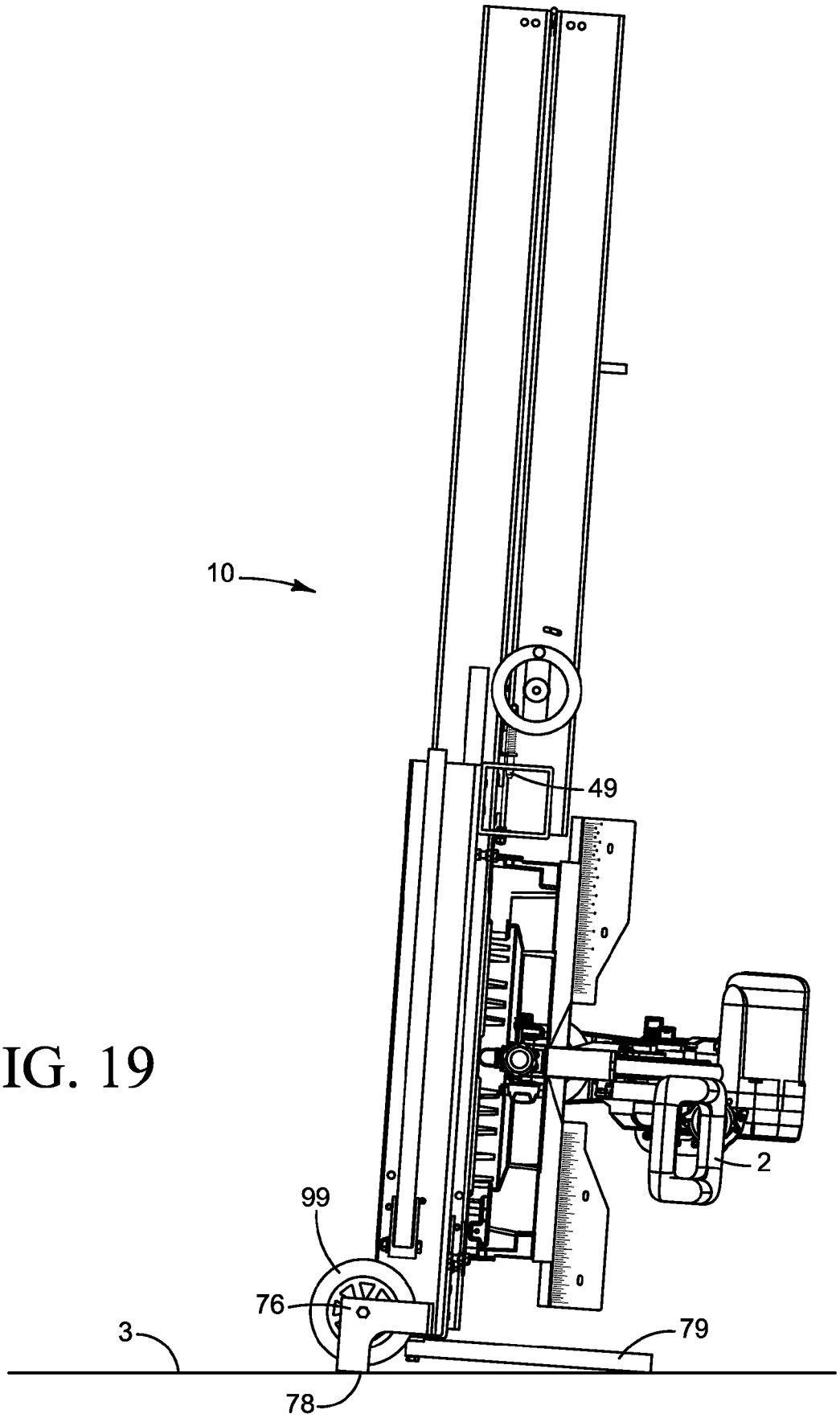
FIG. 19 is a side view of the extension table assembly of FIG. 1 shown folded into its stowed position, shown standing up in a storage mode.

It is further preferred that the surface support 22 comprise at least one wheel support 99 configured for contacting an operational surface 3 when the legs (55, 155) are in the retracted position. One embodiment of a surface support 22 is illustrated in FIGS. 17 through 19, namely a pair of wheel supports (99, 199) connecting to opposite sides of the frame portion 20. FIG. 18 illustrating the exemplary extension table assembly 10 in a towed mode whereby a user could move the first exemplary extension table assembly 10 from a first location to a second location with the wheel supports (99, 199) supporting the assembly while being towed behind the user. The term "towed" used broadly, to include both pulling and pushing movements of the exemplary extension table assembly.

In the first exemplary extension table assembly, the wheel supports (99, 199) further comprise a mount (76, 176) having a storage rest (78, 178) configured for resting upon the surface 3 when the extension table assembly 10 is in its stowed position/storage mode. It is preferred that a kickstand 79 be further provided for stabilizing the extension table assembly 10 when in its stowed position/storage mode, as illustrated in FIG. 19. The kickstand 79 able to be rotated outwards from the frame portion 20 and into place.

Referring to FIGS. 3 and 4, in the first exemplary extension table assembly 10, the arm portion 40 has a distal end 41 and a proximal end 42. The distal end 41 and proximal end 42 define an arm portion length L1 therebetween. Further, the extension arm portion 50 comprises a first end 51 opposite a second end 52. The first end 51 and second end 52 define an extension arm portion length L2 therebetween.

As illustrated in FIGS. 3, 7, 8 and 16, in the first exemplary extension table assembly 10, support surface 44 of the arm portion 40 comprises a first guide channel 45 defined along the length of the arm portion length L1. As illustrated in FIGS. 3, 6, 10 and 16, the extension arm portion 50 comprises a second guide channel 58 is defined along the extension arm portion length L2. While the first guide channel 45 is illustrated as extending from the proximal end 42 to the distal end 41 of the arm portion 40, the guide channel 45 could extend a shorter distance. While the second guide channel 58 is illustrated as extending from the first end 51 to the second end 52 of the extension arm portion 50, the second guide channel 58 could extend a shorter distance. It is preferred that the first guide channel 45 and the second guide channel 58 be aligned when the arm portion 40 and extension arm portion 50 are in their in use position.

Figure 16:
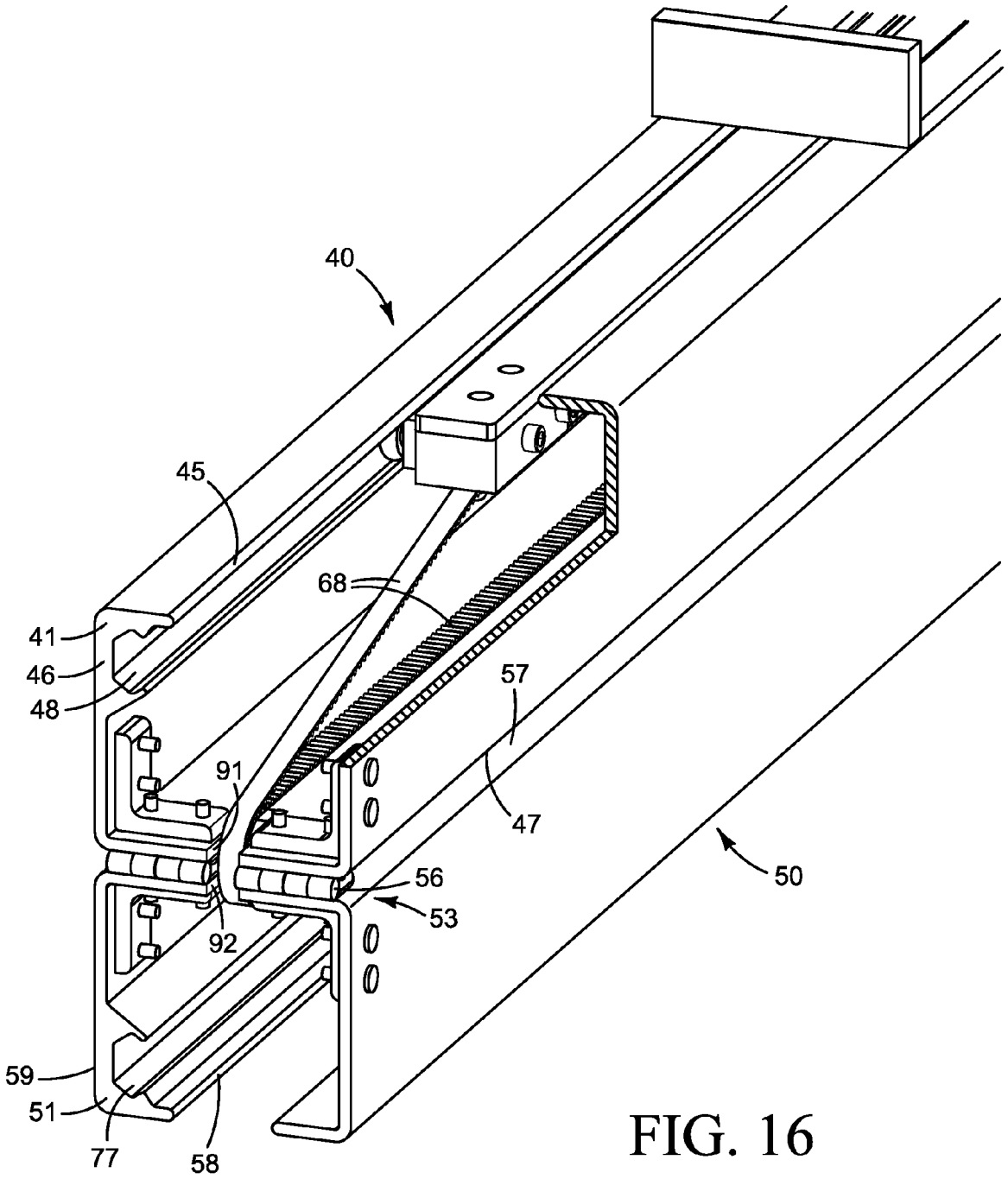
FIG. 16 is a partial, perspective view of the extension table assembly of FIG. 1 shown folded into its stowed position.

Referring now to FIGS. 3 and 16, the arm portion 40 further comprises a rail 46 extending along the length of the arm portion length L1. The rail 46 configured for connecting with the movable carriage 61 so that the movable carriage 61 can be moved along the rail 46. In the illustrated exemplary extension table assembly 10, the rail 46 comprising a generally C-shaped track 48. The extension arm portion 50 further comprises a second rail 59 extending along the length of the extension arm portion length L2. The second rail 59 (like the rail 46) configured for connecting with the movable carriage 61 so that the movable carriage 61 can be moved along the second rail 59. The second rail 59 preferably aligned with the rail 46 in order that the movable carriage 61 can transit from the rail 46 to the second rail 59. In the illustrated exemplary extension table assembly 10, the second rail 59 comprising a generally C-shaped track 77. The exemplary extension table assembly illustrated in the drawings illustrates the rails as being channel-shaped. Alternatively, rails could be shaped otherwise, for instance being rectangular, square or other shaped. A skilled artisan will be able to select an appropriate mount and configuration for the movable carriage as it relates to the arm portions for the extension table assembly in a particular embodiment based on various considerations, including the intended use of the extension table assembly, the intended arena within which the extension table assembly will be used, and the equipment and/or accessories with which the extension table assembly is intended to be used, among other considerations.

Again, while the exemplary extension table assembly 10 is illustrated having a pair of arm portions (the arm portion 40, and the extension arm portion 50), more or less arm portions could be provided in a given extension table assembly, and a skilled artisan will be able to select an appropriate number and configuration of arm portions for the extension table assembly in a particular embodiment based on various considerations, including the intended use of the extension table assembly, the intended arena within which the extension table assembly will be used, and the equipment and/or accessories with which the extension table assembly is intended to be used, among other considerations.

In the first exemplary extension table assembly 10, the first end 51 for the extension arm portion 50 attaches to the distal end 41 of the arm portion 40 through use of an arm connector 53. In the first exemplary extension table assembly, the arm connector 53 comprises at least one hinge portion 56 for hingedly connecting the extension arm portion 50 to the arm portion 40. In another exemplary extension table assembly (not illustrated), the extension arm portion is configured for telescopically extending from the arm portion. While the first exemplary extension table assembly utilizes a hinged arm connector connection, a skilled artisan will be able to select an appropriate structure and configuration for a connector for the extension table assembly in a particular embodiment based on various considerations, including the intended use of the extension table assembly, the intended arena within which the extension table assembly will be used, and the equipment and/or accessories with which the extension table assembly is intended to be used, among other considerations.

Together, the arm portion 40 and the extension arm portion 50 have a use position (illustrated in FIG. 1) and a stowed position (illustrated in FIGS. 14 through 19).

Figure 12:
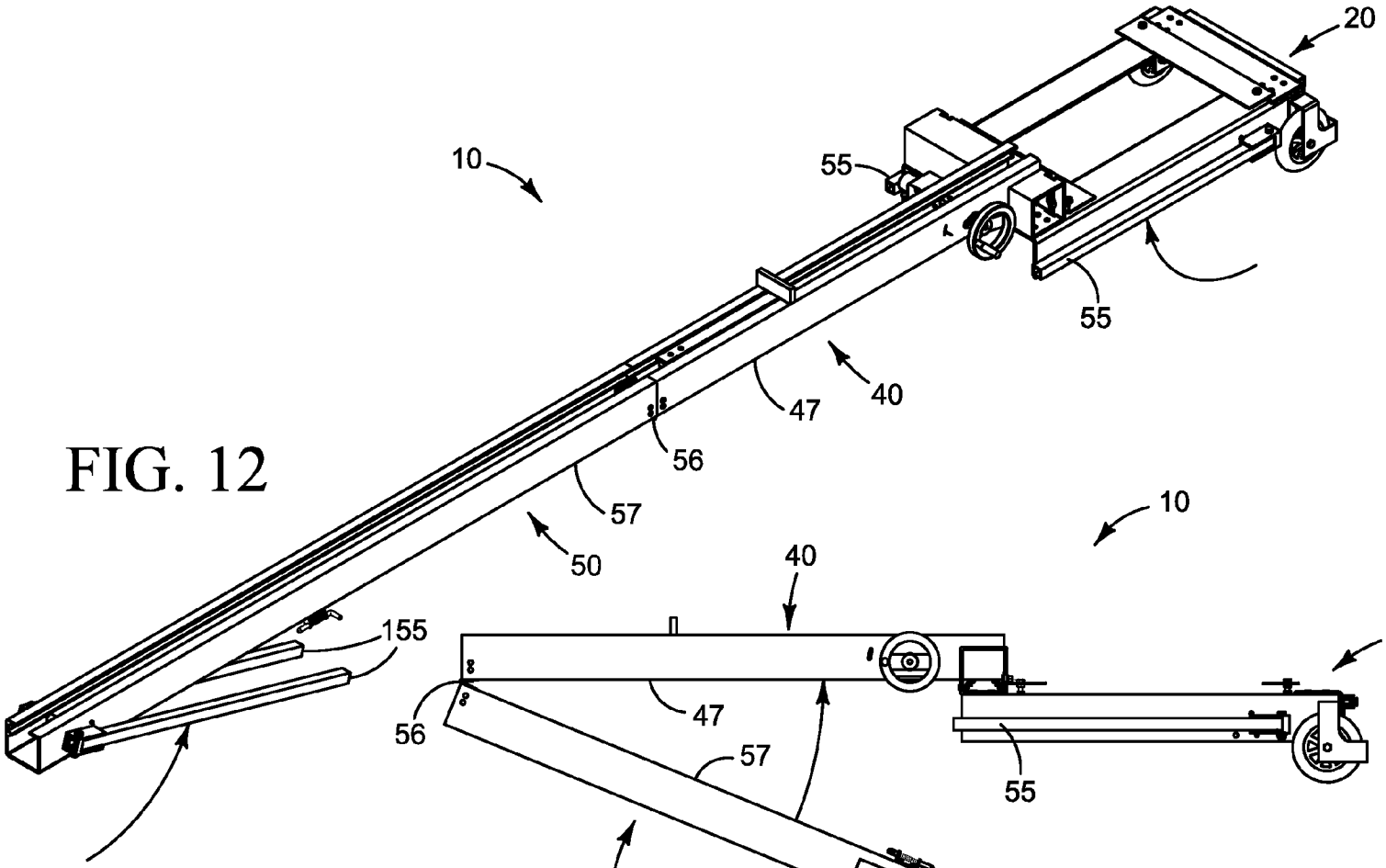
Figure 13:
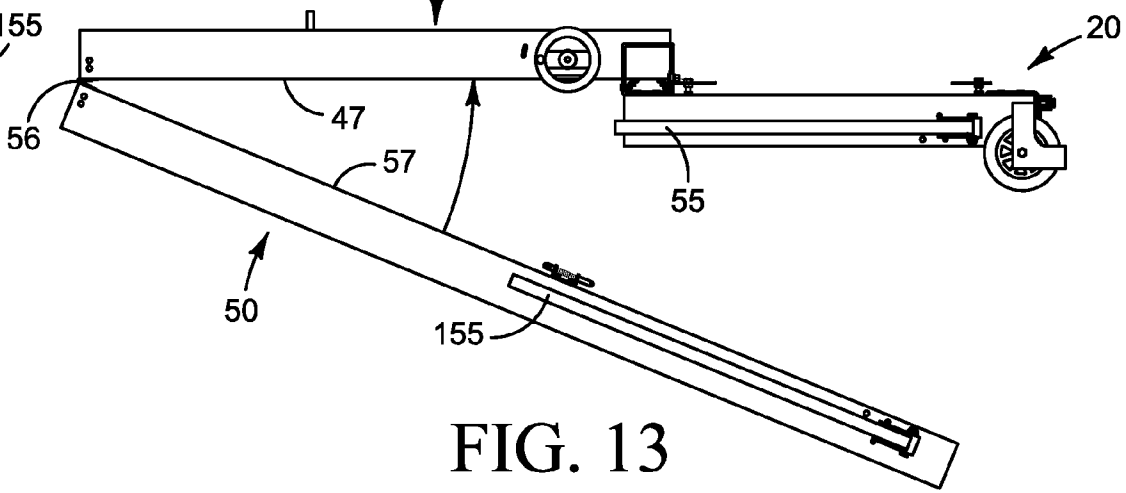
Figures 14, 15:
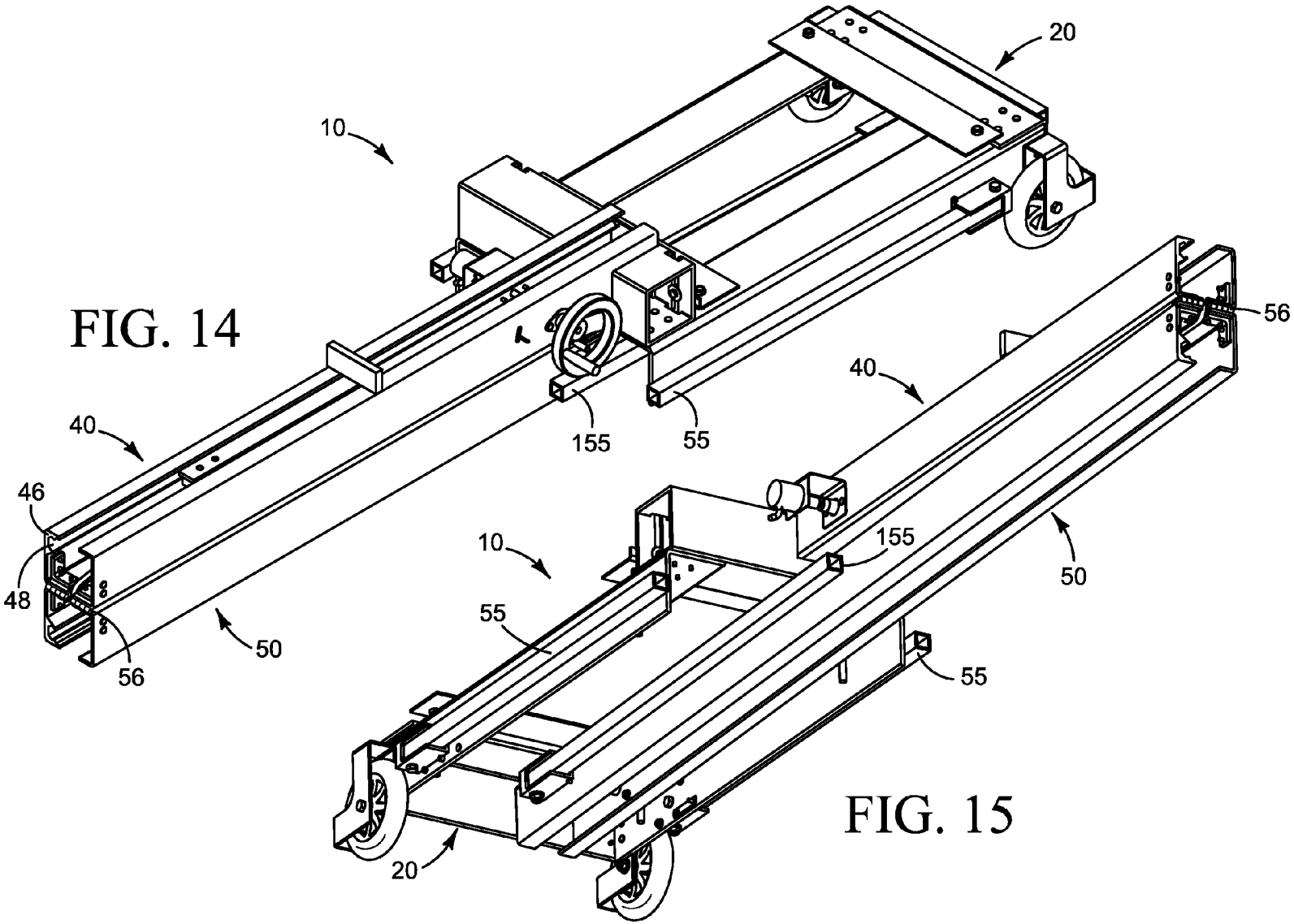

As illustrated in FIGS. 12, 13 and 16, the arm portion 40 comprises an underside surface 47, and the extension arm portion 50 comprises an underside surface 57. When in the stowed position, the arm portion 40 and the extension arm portion 50 are folded together (as illustrated in FIG. 13) so that the underside surfaces (47, 57) face one another. A locking device 49 (illustrated in FIGS. 1, 4, 18 and 19) may be utilized to lock the arm portion 40 and the extension arm portion 50 in their stowed position.

When in the use position, the arm portion 40 and the extension arm portion 50 are unfolded from facing one another, and the arm portion 40 and the extension arm portion 50 are arranged in an end-to-end fashion with the underside surfaces (47, 57) generally planar with one another, as illustrated in FIG. 1.

As illustrated in FIG. 16, the arm portion 40 further comprises a first notch 91 configured for receiving a portion of the belt 68 when in the stowed position, and the extended arm portion 50 further comprises a second notch 92 configured for receiving a portion of the belt 68 when in the stowed position. These notches allowing the extension table assembly 10 to be folded into a stowed position without stretching the belt 68, or needing a tensioning device. In other embodiments, a tensioning device for applying tension to the belt may be included.

The drive system 60 for providing a movable end stop location. The drive system 60 comprises a movable carriage 61 and a shuttle 70 having an end stop 71. The end stop 71 providing a location (first surface 35, second surface 36) against which an end of the material 6 to be cut is placed. The movable carriage 61 configured for moving along the first rail 46 of the arm portion 40, and the second rail 59 of the extension arm portion 50.

In the first exemplary extension table assembly 10, the movable carriage 61 is bolted to the belt 68. While bolting the movable carriage to the belt is disclosed and illustrated, a skilled artisan will be able to select an appropriate manner of connecting the two structures together in a particular embodiment based on various considerations, including the intended use of the extension table assembly, the intended arena within which the extension table assembly will be used, and the equipment and/or accessories with which the extension table assembly is intended to be used, among other considerations.

Figure 5:
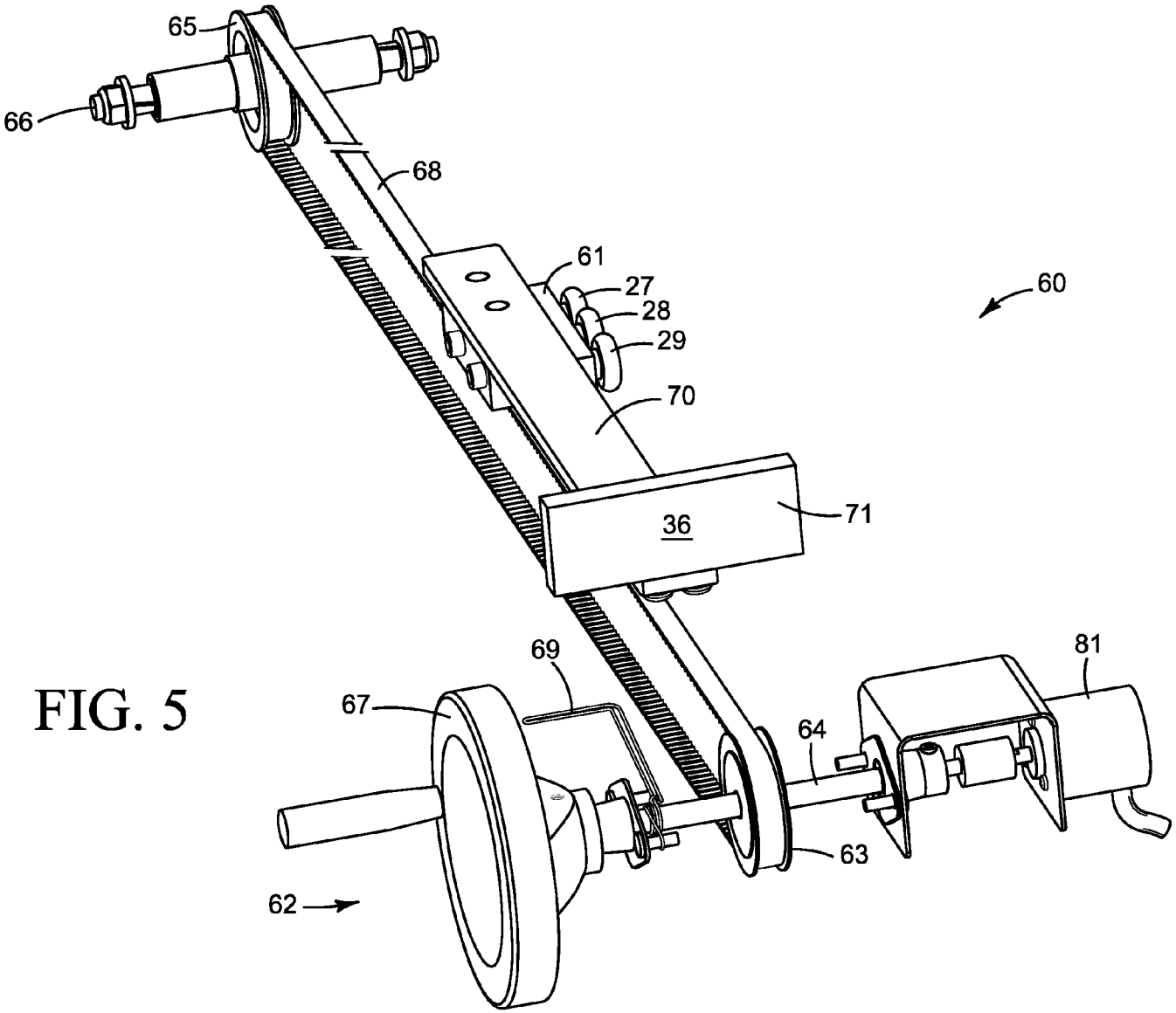
FIG. 5 is a partial, perspective view of the drive system of the extension table assembly of FIG. 1.

In the first exemplary extension table assembly 10 illustrated in the Figures, the drive system 60 comprise a drive 62 for driving the movable carriage 61 along the first rail 46 of the arm portion 40, and the second rail 59 of the extension arm portion 50. Referring particularly to FIG. 5, the drive 62 comprises a drive pulley 63 on a drive shaft 64, a second pulley 65 on a second shaft 66, a hand-wheel 67 for turning the drive shaft 64, and a belt 68 extending between the drive pulley 63 and the second pulley 65. It is preferred that the drive pulley 63 and second pulley 65 comprise teeth configured for intermeshing with teeth on the belt 68.

As illustrated in FIG. 4, rotation of the hand-wheel 67 in a first direction F1 causes the movable carriage 61 to advance along the rail 46 in a first direction F2, whereas rotation of the hand-wheel 67 in a second direction S1 causes the movable carriage 61 to advance along the rail 46 in a second direction S2.

Referring back to FIG. 3, in the exemplary extension table assembly 10, the drive pulley 63 is located towards the proximal end 42 of the arm portion 40, and the second pulley 65 is located towards the second end 52 of the extension arm portion 50. A skilled artisan will be able to select an appropriate location and structure for the drive pulley and second pulley in a particular embodiment based on various considerations, including the intended use of the extension table assembly, the intended arena within which the extension table assembly will be used, and the equipment and/or accessories with which the extension table assembly is intended to be used, among other considerations.

Alternatively, the drive could comprise a linear actuator drive system, a rack-and-pinion system, a belt-drive system, a roller chain system, a helical gear system (aka "worm gears"), a cable/rope and pulley system, or other systems, and a skilled artisan will be able to select an appropriate drive for the extension table assembly in a particular embodiment based on various considerations, including the intended use of the extension table assembly, the intended arena within which the extension table assembly will be used, and the equipment and/or accessories with which the extension table assembly is intended to be used, among other considerations. Further, the drive could be mechanical actuator powered, hydraulic actuator powered, pneumatic actuator powered, piezoelectric actuator powered, electromechanical powered, telescoping linear powered, or other systems and a skilled artisan will be able to select an appropriate drive for the extension table assembly in a particular embodiment based on various considerations, including the intended use of the extension table assembly, the intended arena within which the extension table assembly will be used, and the equipment and/or accessories with which the extension table assembly is intended to be used, among other considerations.

Figure 6:
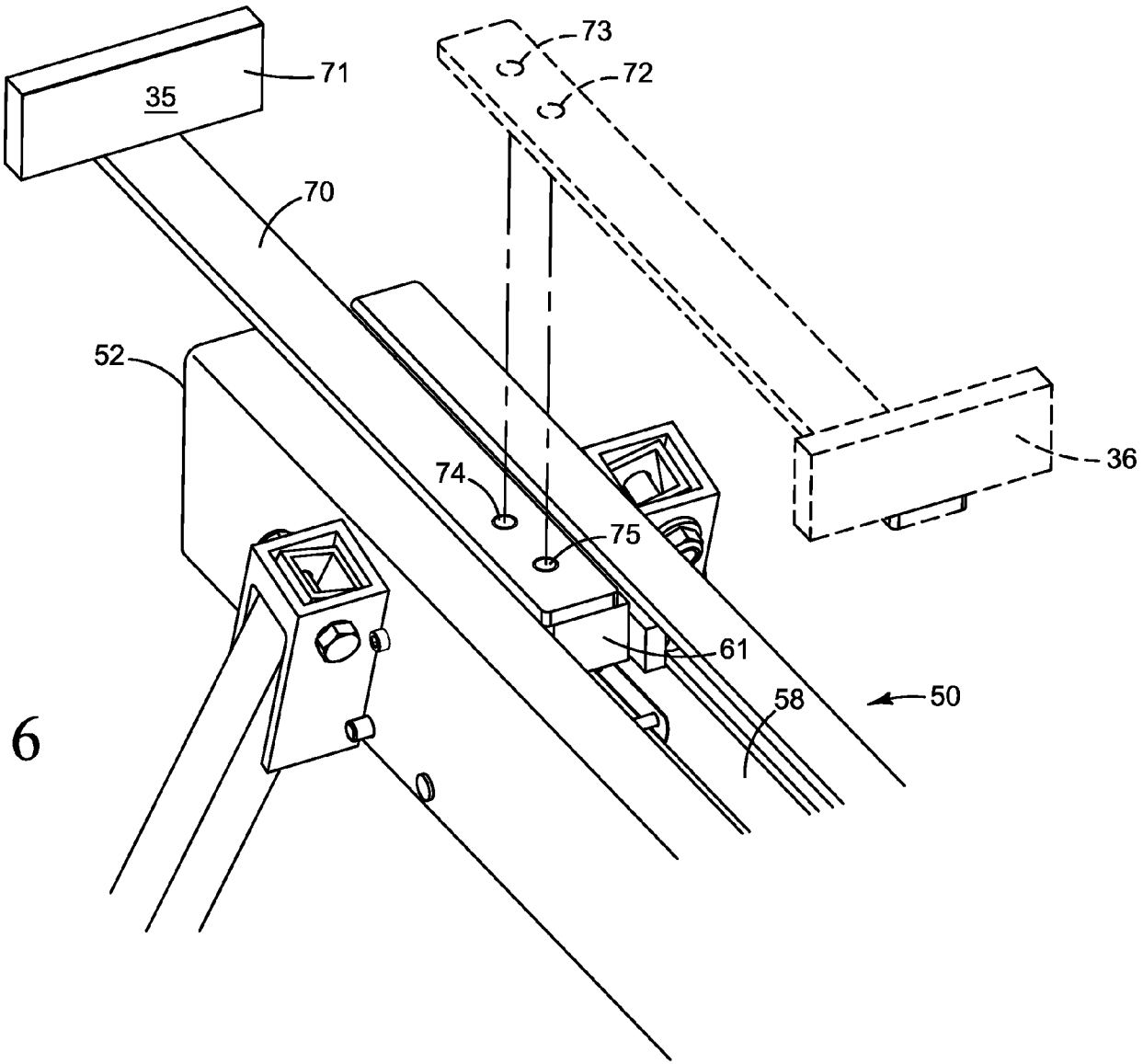
FIG. 6 is a partial, perspective view of a portion of the extension table assembly of FIG. 1.
Figure 7:
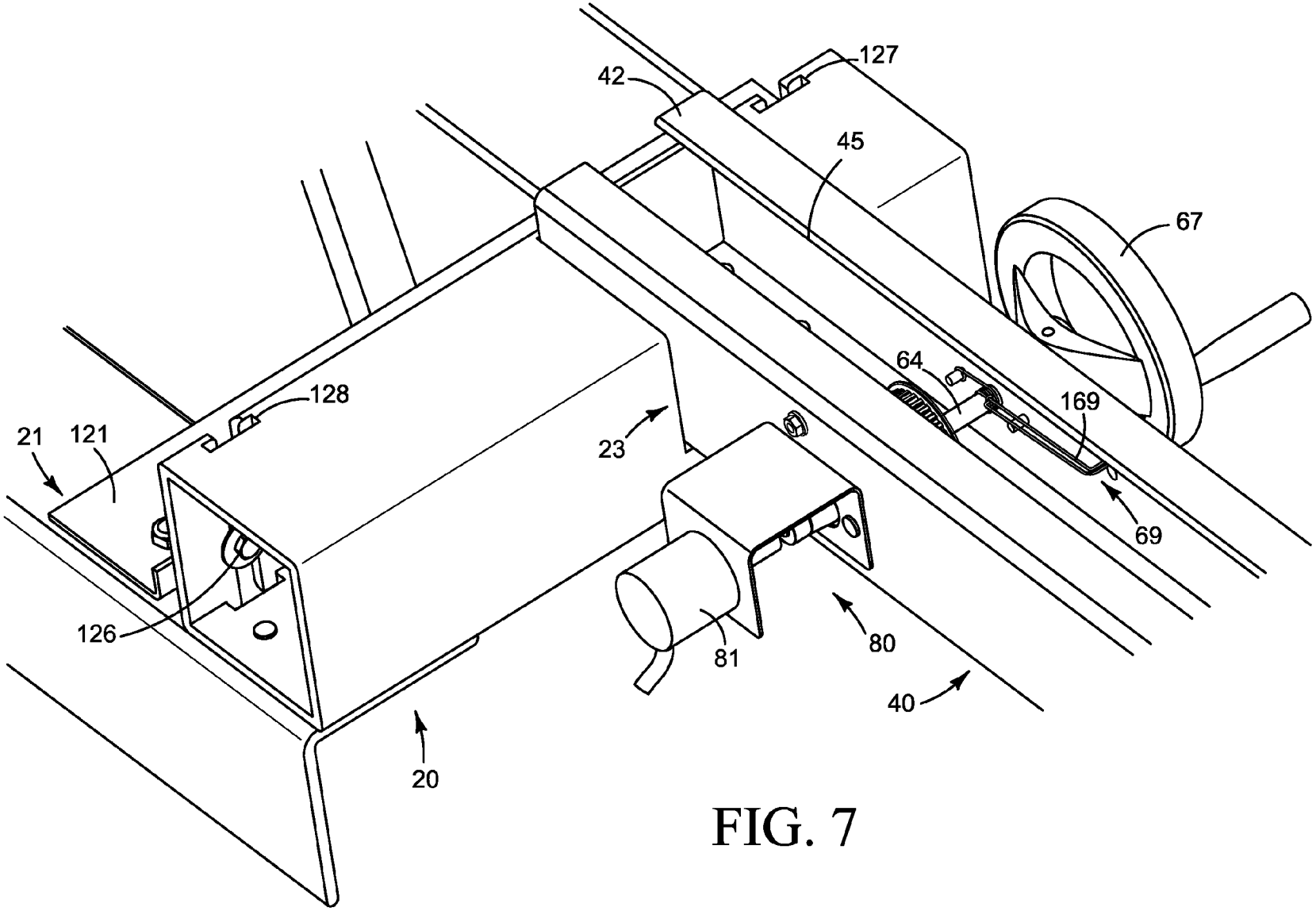
Figure 8:
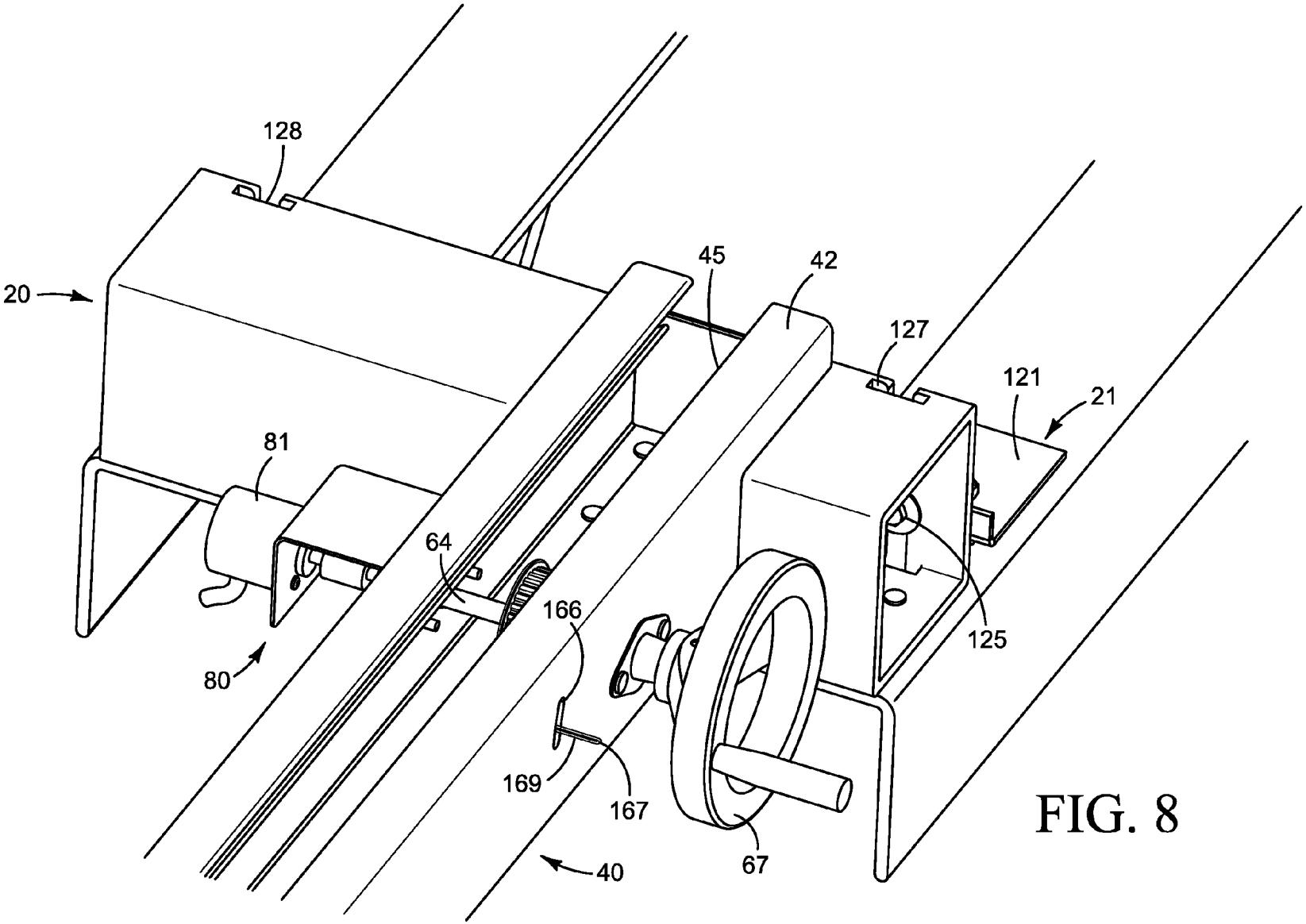
Figure 9:
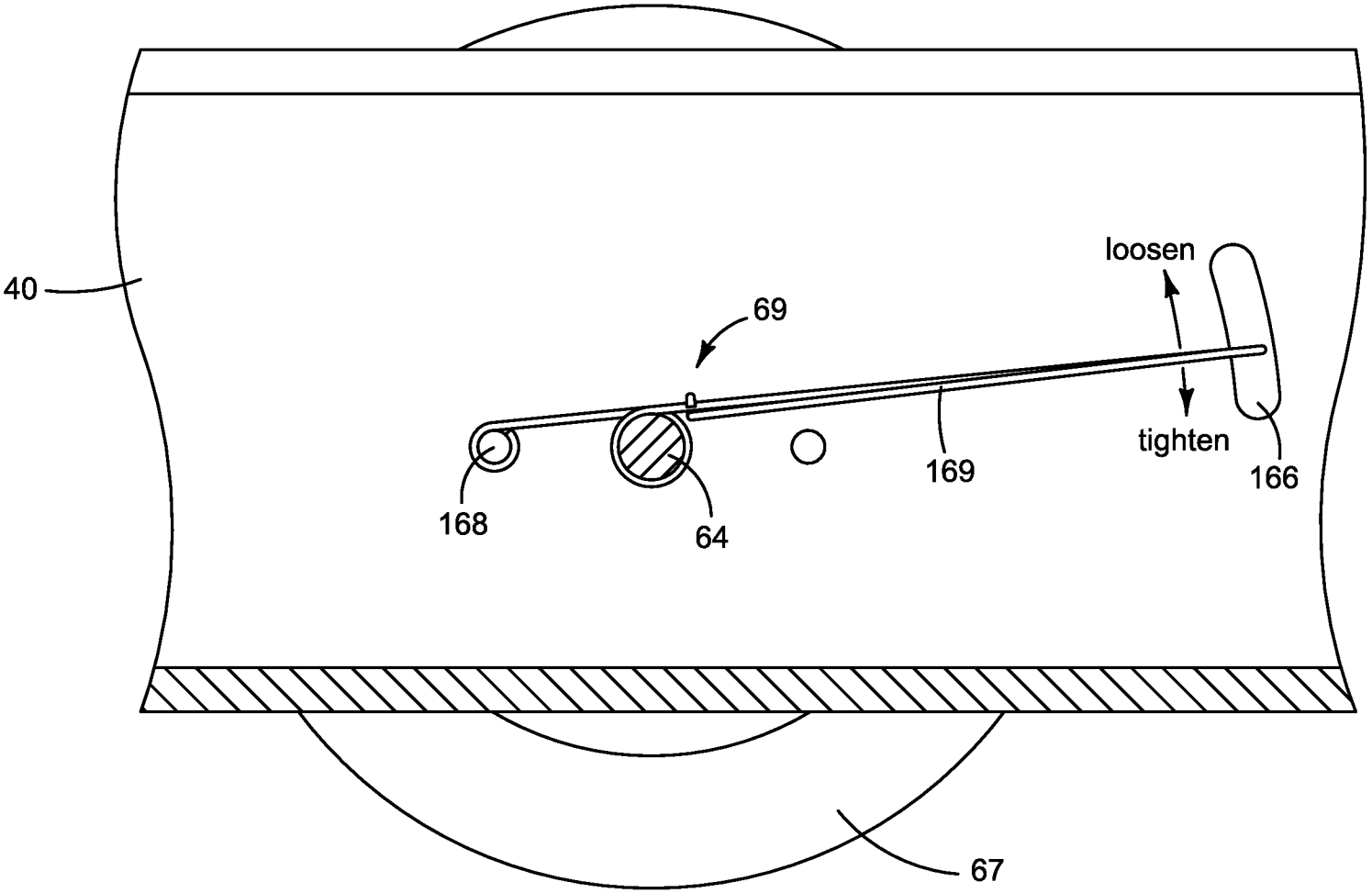
FIG. 9 is a partial, side view of a portion of the extension table assembly of FIG. 1.

Referring now to FIGS. 5 and 6, the shuttle 70 is preferably configured to connect to, or otherwise extends from, the movable carriage 61. Alternatively, the shuttle could be formed as part of the movable carriage itself. In the first exemplary extension table assembly 10, the shuttle 70 comprises a generally L-shaped body having an end stop 71 extending therefrom as one of the legs of the general L-shape.

The end stop 71 for abutting an end of material 6 to be worked, having a first surface 35 for contacting material, and a second surface 36 for contacting material. In the first exemplary extension table assembly 10, the shuttle 70 comprises a generally L-shaped body having an end stop 71 extending there-from as one of the legs of the general L-shape.

In the first exemplary extension table assembly 10, as illustrated in FIGS. 5 and 6, the shuttle 70 attaches to the movable carriage 61 via a friction fit. While such a connection is illustrated, other connections are possible, including, but not limited to, adhesives, and mechanical fasteners. The shuttle 70 comprises a first bore 72 and a second bore 73 defined therethrough. The movable carriage 61 comprises a first pin 74 and a second pin 75 extending therefrom. The pins (74, 75) complement the bores (72, 73) so that the first bore 72 can be slid onto the first pin 74, and the second bore 73 can be slid onto the second pin 75. Alternatively, the shuttle could comprise one or more pins extending there-from which are configured for engagement with one or more bores defined in the movable carriage. A skilled artisan will be able to select an appropriate structure and material for the connection in a particular embodiment based on various considerations.

Further, the shuttle 70 can be detached from the movable carriage 61 and rotated one-hundred eighty degrees, so that the first bore 72 can be slid onto the second pin 75, and the second bore 73 can be slid onto the first pin 74. Such a configuration allowing the end stop 71 to, optionally, be located closer to, or further from, the working area 8, for instance when a very short piece of material 6 is modified, thereby enabling the first surface 35 or the second surface 36 to contact the material 6 (a first surface facing position (the working area) and a second surface facing position). Further, the shuttle 70 can be detached from the movable carriage 61 so as to allow a very long length of material 6 to extend past the location of the movable carriage 61.

It is preferred that the extension table assembly 10 further comprise a carriage position lock 69 for selectively preventing rotation of the drive shaft 64 or otherwise preventing the drive system 60 (and the movable carriage 61) from moving. By preventing rotation of the drive shaft 64, the movable carriage 61 is able to be fixed in place so that the first surface 35 (or the second surface 36) of the end stop 71 is locked a predetermined distance from the working area 8. As particularly illustrated in FIGS. 7 through 9, the carriage position lock 69 comprises a spring 169 wrapped around the drive shaft 64, the spring 169 biased in a locked position where rotation of the drive shaft 64 is prevented. The spring 169 connecting at a first end to a pin 168, whereas a second end extends through a passageway 166 defined in the arm portion 40, and comprises a lever 167 which a user can move in a first direction to unlock the carriage position lock 69. Whereas, releasing the lever 167 results in biased movement of the lever in the second direction returning the carriage position lock 69 to its locked position whereby the drive shaft 64 is prevented from further rotation, as particularly illustrated in FIG. 9.

While this is the preferred configuration for a carriage position lock 69, other types of mechanisms and systems could be used for locking the position of the carriage (e.g., self locking helical gears, self locking motors), and a skilled artisan will be able to select an appropriate structure and material for the lock in a particular embodiment based on various considerations, including the intended use of the extension table assembly, the intended arena within which the extension table assembly will be used, and the equipment and/or accessories with which the extension table assembly is intended to be used, among other considerations. In one example, the lock system comprises a brake disc and brake caliper style system.

Figure 10:
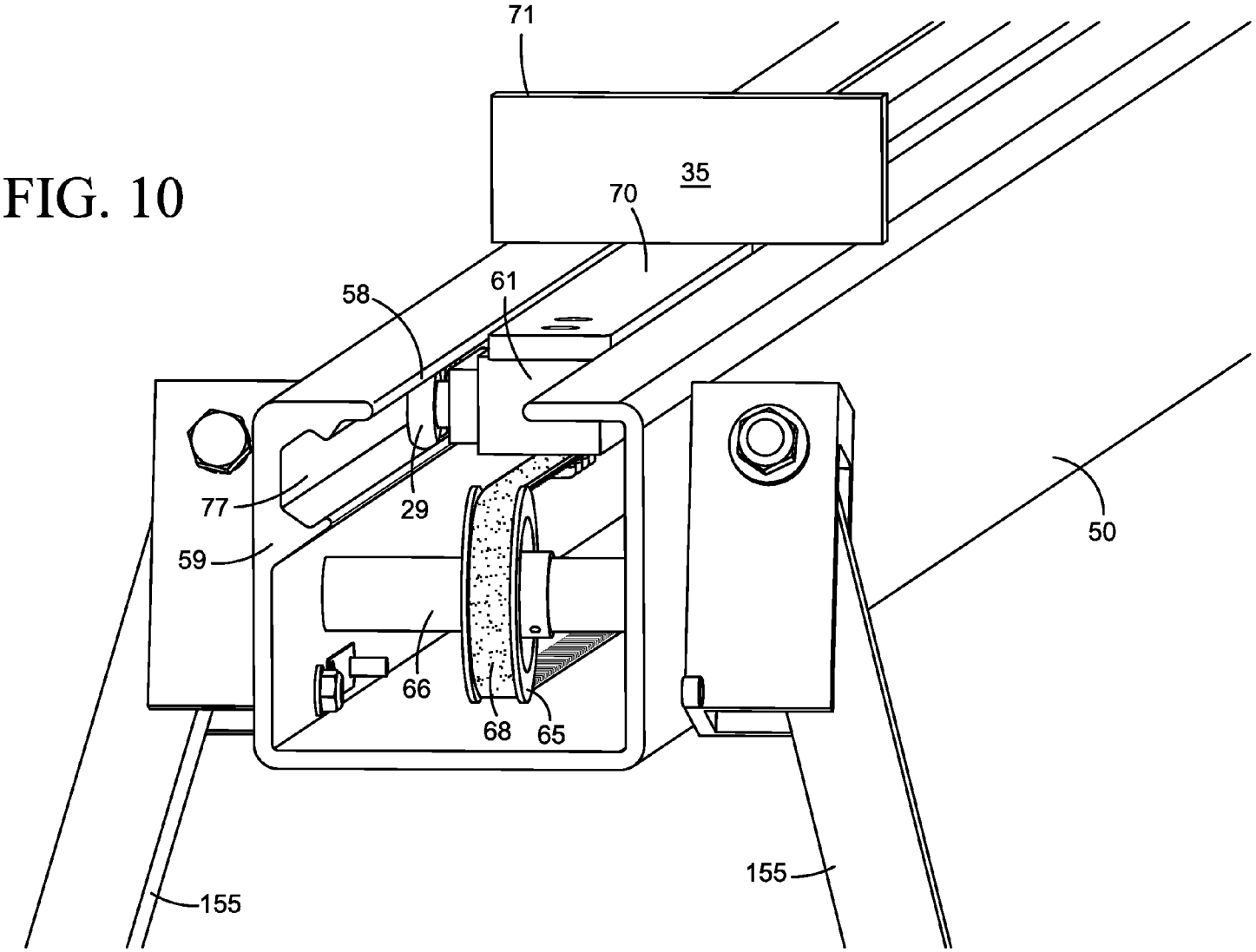
FIG. 10 is a partial, perspective end view of a portion of the extension table assembly of FIG. 1.
Figure 11:
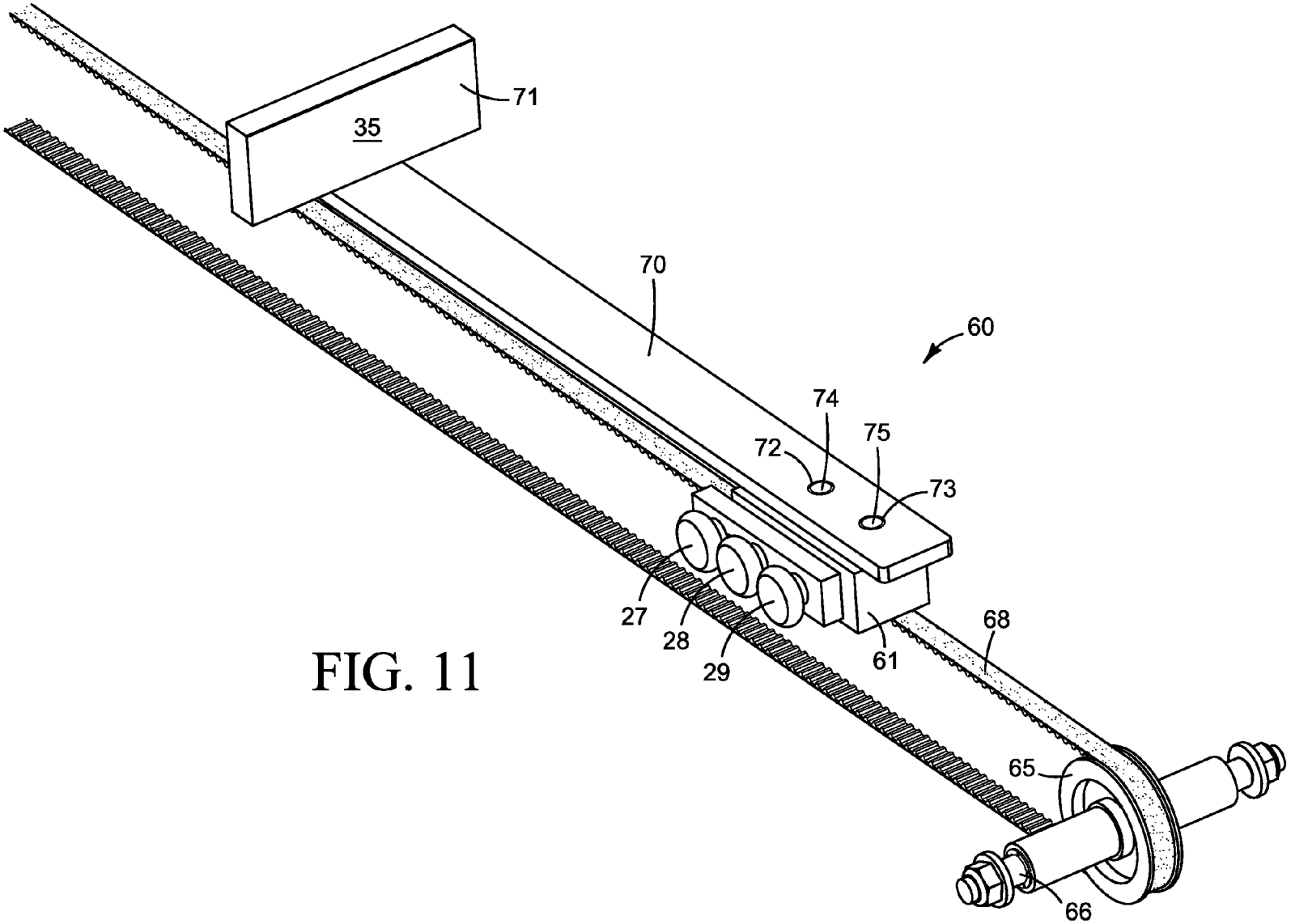
FIG. 11 is a partial, perspective view of a portion of the extension table assembly of FIG. 1.

Referring now, particularly, to FIGS. 10 and 11, extending from the movable carriage 61 is at least one wheel, preferably a plurality of wheels (27, 28, 29). In the first exemplary extension table assembly 10, the plurality of wheels (27, 28, 29) extend from one side of the movable carriage 61. In other embodiments, the wheels may extend from a different side or even from multiple sides of the movable carriage. The C-shaped track 48 of the arm portion 40 is configured for receiving therein the plurality of wheels (27, 28, 29), thereby allowing the movable carriage 61 to roll along the C-shaped track 48 in a first direction and a second direction. Likewise, if present, the C-shaped track 77 of the extension arm portion 50 is configured for receiving therein the plurality of wheels (27, 28, 29), thereby allowing the movable carriage 61 to roll along the C-shaped track 77 in a first direction and a second direction. While this (wheels mounted on a track) is the preferred manner of connecting the movable carriage to the arm portion, other types of mechanisms and systems could be utilized, and a skilled artisan will be able to select an appropriate structure and material for the carriage connection in a particular embodiment based on various considerations, including the intended use of the extension table assembly, the intended arena within which the extension table assembly will be used, and the equipment and/or accessories with which the extension table assembly is intended to be used, among other considerations.

The first exemplary extension table assembly 10 further comprises a measurement system 80 for computing the distance between the first surface 35 and/or the second surface 36 of the end stop 71 and the working area 8 to determine a material length. The measurement system 80 comprises a sensor 81 for sensing the relative position of the first surface 35 and/or the second surface 36 of the end stop 71 relative to the working area 8. Based upon this measurement, the sensor 81 generates an end stop signal. The sensor 81 illustrated in the figures comprising a rotary encoder connected to the drive shaft 64, wherein rotation of the drive shaft 64 is converted to analog or digital code (the end stop signal). For instance rotation of one degree could be equal to 1/32 of an inch in length. While a rotary encoder is the preferred sensor, other types of mechanisms and systems could be utilized, and a skilled artisan will be able to select an appropriate structure and material for the sensor in a particular embodiment based on various considerations, including the intended use of the extension table assembly, the intended arena within which the extension table assembly will be used, and the equipment and/or accessories with which the extension table assembly is intended to be used, among other considerations. Examples of other sensors include, but are not limited to, other types of encoders (e.g., optical encoders, mechanical encoders, electronic encoders), laser measurement (e.g., laser rangefinders such as those manufactured by Dimetix AG), ultrasonic measurement, and "digital tape measures."

The measurement system 80 further comprises a microprocessor 82 and an alpha-numeric display device 83. In the figures, the microprocessor 82 is integrated into the housing of the alpha-numeric display device 83. In other embodiments, the microprocessor may be located separate therefrom. The microprocessor 82 receives the end stop signal from the sensor 81, and determines the distance from the end stop 71 to the working area 8. In doing so, the material length can be computed. This computation can further take into consideration whether the carriage is in its first surface facing position, or its second surface facing position, factoring the length or offset of the shuttle 70 into the computation, as necessary.

Preferably, the microprocessor 82 outputs a length signal corresponding to the material length. The alpha-numeric display device 83 receives the length signal from the microprocessor 82, and provides an alpha-numeric representation of the material length to an operator of the extension table assembly 10, for instance that the first surface 35 of the end stop 71 is located six-feet, two and one-quarter inches from the working area 8.

Additionally, given inputs from the operator for compound cuts such as spring angle of the material, various widths and thicknesses of the material, and/or the wall condition for the cut, the microprocessor 82 can provide an output to the alpha-numeric display device 83 for the operator representing the bevel and miter angles at which to set the saw. Further, given an end stop signal, the microprocessor 82 can provide the shortest-to-shortest, longest-to-longest, shortest-to-longest, and/or the longest-to-shortest point lengths on rectangular and crown molding materials in a compound cut.

In the first exemplary extension table assembly 10, where the power tool 2 comprises a miter saw, the alpha-numeric display device 83 could display other information, including but not limited to: the current angle (in the vertical plane) of the saw blade relative to the material (miter cut); the distance from the inside corner (of a miter cut) to the end stop (first surface 35 and/or second surface 36); the distance from the outside corner (of a miter cut) to the end stop (first surface 35 and/or second surface 36); the distance from between two inside, two outside, inside-to-outside, or outside-to-inside corners of a miter cut (first surface 35 and/or second surface 36) when the material is placed against the end stop; the distance between two first edges, two second edges or one of each edge of a bevel cut (1st/2nd surface) when the material is placed against the end stop; the current angle (in a bisecting plane) of the saw blade relative to the material (bevel cut); the distance from the first edge (of a bevel cut) to the end stop (first surface 35 and/or second surface 36); the distance from a second edge (of a bevel cut) to the end stop (first surface 35 and/or second surface 36); the distance between two first edges, two second edges or one of each edge of a bevel cut (first surface 35 and/or second surface 36) when the material is placed against the end stop; etc. It is preferred that an operator would be able to change the display of the alpha-numeric display device to display information in feet/inches/fractions, inches/fractions, metric units, etc.

A second exemplary extension table assembly for power tools comprises one or more of at least one tool mount, at least two arm portions, at least one guide channel, a carriage, at least one end stop assembly, a drive system, a measurement system, an alpha-numeric display device, at least one hinge connecting the arm portions together, and legs.

A third exemplary extension table assembly for power tools comprises one or more of at least one tool mount, at least one arm portion, at least one guide channel, a carriage, at least one end stop assembly, a drive system, a measurement system, and an alpha-numeric display device.

A fourth exemplary extension table assembly for power tools comprises one or more of at least one tool mount, at least two arm portions, a carriage, at least one end stop assembly, a drive system, a measurement system, an alpha-numeric display device, a connector connecting said arm portions together.

Embodiment 1

An exemplary extension table assembly for a power tool having a working surface for supporting a piece of material to be modified, and a working area where the power tool can modify (e.g., cut) a piece of material. The exemplary extension table assembly comprising a frame portion, an arm portion, at least one drive system, and a measurement system. The frame portion for supporting the power tool above a surface. The frame portion comprising at least one power tool mount configured for mounting the power tool there-on. The frame portion comprising at least one surface support for supporting the frame portion above a surface, and at least one connector for connecting the frame portion to the arm portion. The arm portion comprising a distal end and a proximal end. The distal and proximal ends defining an arm portion length there-between. The proximal end connects with the frame portion at the connector. The arm portion further comprising a support surface for supporting the piece of material to be modified. It is preferred that the support surface be generally planar to the working surface. The drive system comprising a movable carriage and a shuttle having an end stop. The measurement system for computing the distance between the end stop and the working area to determine a material length.

Preferably, the power tool mount is fixed in location relative to the frame portion, and fixed in place relative to the arm portion. Preferably, the frame portion comprises a first side opposite a second side, wherein the connector attaches the arm portion to the frame portion so that the arm portion generally extends away from the first side. Preferably, the surface support comprises a plurality of legs, wherein the legs are configured for extending between an extended position and a retracted position, and wherein the surface support comprises at least one wheel configured for contacting the surface when the legs are in the retracted position. Preferably, a first guide channel is defined along the arm portion length, the first guide channel comprising a rail, the movable carriage configured for moving along the rail. Preferably, the extension table assembly further comprises an extension arm portion having a first end opposite a second end defining an extension arm portion length therebetween, the first end attaching to the distal end via an arm connector. Preferably, the extension arm portion further comprises a second surface support for supporting the extension arm portion above the surface. Preferably, the second surface support comprises a plurality of legs, wherein the legs are configured for extending between an extended position and a retracted position. Preferably, the arm portion and the extension arm portion have a use position and a stowed position, wherein the arm connector comprises a hinge portion for hingedly connecting the extension arm portion to the arm portion, wherein the arm portion comprises an underside surface and the extension arm portion comprises an underside surface, wherein in the stowed position the arm portion and the extension arm portion are folded together so that the underside surfaces face one another. Preferably, a second guide channel is defined along the extension arm portion length, the second guide channel comprising a second rail, the movable carriage configured for moving along the second rail, the second guide channel aligned with the first guide channel when the arm portion and the extension arm portion are in their use position. Preferably, the extension arm portion further comprises a second support surface for supporting the piece of material to be modified, the second support surface generally planar to the support surface when the arm portion and the extension arm portion are in their use position. Preferably, the measurement system comprises a sensor for sensing the relative position of the end stop relative to the working area and generating an end stop signal. Preferably, the measurement system further comprises a microprocessor and an alpha-numeric display device, wherein the microprocessor receives the end stop signal from the sensor, wherein the microprocessor determines the distance from the end stop to the working area thereby computing the material length, wherein the microprocessor outputs a length signal corresponding to the material length, wherein the alpha-numeric display device receives the length signal from the microprocessor and provides an alpha-numeric representation of the material length. Preferably, the drive system further comprises a drive for driving the movable carriage along the rail. Preferably, a first guide channel is defined along the arm portion length, the first guide channel comprising a rail, the movable carriage configured for moving along the rail, wherein the drive drives the movable carriage along the rail. Preferably, the drive comprises: a drive pulley on a drive shaft, a second pulley on a second shaft, a hand-wheel for turning the drive shaft, and a belt extending between the drive pulley and the second pulley, wherein the movable carriage is attached to the belt, wherein rotation of the hand-wheel in a first direction causes the movable carriage to advance along the rail in a first direction, and rotation of the hand-wheel in a second direction causes the movable carriage to advance along the rail in a second direction. Preferably, the drive further comprises a lock for preventing rotation of the drive shaft thereby locking the movable carriage in place.

Preferably, the power tool is a saw. Preferably, the power tool working area comprises the plane of cut of the saw where the saw is configured for cutting the/a piece of material. Preferably, the power tool mount comprises a platform defining a plurality of mounting holes defined there-through, wherein a plurality of bolts can be inserted through the mounting holes and threaded into threaded holes defined in the power tool thereby attaching the power tool to the power tool mount.

Optionally, the frame portion comprises one or more spacers for spacing the tool apart from the platform, the spacers comprising a plurality of spacer holes defined there-through, the one or more of the spacer holes configured for alignment with one or more of the mounting holes, wherein at least one of the plurality of bolts extends through one of the mounting holes and is threaded into one of the threaded holes.

Embodiment 2

An exemplary extension table assembly for a power tool having a working surface for supporting a piece of material to be modified, and a working area where the power tool can modify (e.g., cut) a piece of material. The exemplary extension table assembly for a power tool comprising a frame portion, an arm portion, at least one drive system, and a measurement system. The frame portion comprising at least one power tool mount. The power tool mount configured for mounting the power tool there-on. The frame portion comprising at least one surface support for supporting the frame portion above a surface. The frame portion comprising at least one connector for connecting the frame portion to the arm portion. The arm portion comprising a distal end and a proximal end defining an arm portion length therebetween, wherein the proximal end connects with frame portion at the connector. The arm portion further comprising a support surface for supporting the piece of material to be modified, the support surface generally planar to the working surface. The drive system comprising a movable carriage and a shuttle having an end stop, wherein the drive system further comprises a drive for driving the movable carriage along the rail. The measurement system comprises a sensor for sensing the relative position of the end stop relative to the working area and generating an end stop signal. The measurement system further comprises a microprocessor and an alpha-numeric display device. The microprocessor receives the end stop signal from the sensor. The microprocessor determines the distance from the end stop to the working area thereby computing the material length. The microprocessor outputs a length signal corresponding to the material length. The alpha-numeric display device receives the length signal from the microprocessor and provides an alpha-numeric representation of the material length.

Preferably, the extension table assembly comprises an extension arm portion. The extension arm portion having a first end opposite a second end defining an extension arm portion length there-between. The first end attaching to the distal end via an arm connector. The extension arm portion further comprises a second surface support for supporting the extension arm portion above the surface. The second surface support comprising a plurality of legs. The legs are configured for extending between an extended position and a retracted position.

Preferably, a second guide channel is defined along the extension arm portion length. The second guide channel comprising a second rail. The movable carriage configured for moving along the second rail. The second guide channel aligned with the first guide channel when the arm portion and the extension arm portion are in their use position. The extension arm portion further comprising a second support surface for supporting the piece of material to be modified, the second support surface generally planar to the support surface when the arm portion and the extension arm portion are in their use position.

Preferably, the arm portion and the extension arm portion have a use position and a stowed position. The arm connector comprising a hinge portion for hingedly connecting the extension arm portion to the arm portion. The arm portion comprises an underside surface and the extension arm portion comprises an underside surface, wherein in the stowed position the arm portion and the extension arm portion are folded together so that the underside surfaces face one another.

Embodiment 3

An exemplary extension table assembly for a power tool having a working surface for supporting a piece of material to be modified, and a working area where the power tool can modify (e.g., cut) a piece of material. The exemplary extension table assembly for a power tool comprising a frame portion, an arm portion, at least one drive system, and a measurement system. The frame portion comprising at least one power tool mount. The power tool mount configured for mounting the power tool there-on. The frame portion comprising at least one surface support for supporting the frame portion above a surface. The frame portion comprising at least one connector for connecting the frame portion to the arm portion. The arm portion comprising a distal end and a proximal end defining an arm portion length therebetween, wherein the proximal end connects with frame portion at the connector. The arm portion further comprising a support surface for supporting the piece of material to be modified, the support surface generally planar to the working surface, wherein a first guide channel is defined along the arm portion length, the first guide channel comprising a first rail, the movable carriage configured for moving along the first rail. The extension arm portion having a first end opposite a second end defining an extension arm portion length therebetween, the first end attaching to the distal end via an arm connector, the extension arm portion further comprises a second surface support for supporting the extension arm portion above the surface, the second surface support comprising a plurality of legs, wherein the legs are configured for extending between an extended position and a retracted position, wherein a second guide channel is defined along the extension arm portion length, the second guide channel comprising a second rail, the movable carriage configured for moving along the second rail, the second guide channel aligned with the first guide channel when the arm portion and the extension arm portion are in their use position, wherein the extension arm portion further comprising a second support surface for supporting the piece of material to be modified, the second support surface generally planar to the support surface when the arm portion and the extension arm portion are in their use position. The arm portion and the extension arm portion have a use position and a stowed position, wherein the arm connector comprises a hinge portion for hingedly connecting the extension arm portion to the arm portion, wherein the arm portion and the extension arm portion each comprises an underside surface, wherein in the stowed position the arm portion and the extension arm portion are folded together so that the underside surfaces face one another. The drive system comprising a movable carriage having an end stop, wherein the drive system further comprises a drive for driving the movable carriage along rail, wherein the drive comprises: a drive pulley on a drive shaft, a second pulley on a second shaft, a hand-wheel for turning the drive shaft, and a belt extending between the drive pulley and the second pulley, wherein the movable carriage is attached to the belt, wherein rotation of the hand-wheel in a first direction causes the movable carriage to advance along the rail in a first direction, and wherein rotation of the hand-wheel in a second direction causes the movable carriage to advance along the rail in a second direction. The measurement system comprises a rotary encoder on the drive shaft, the rotary encoder for sensing the relative position of the end stop relative to the working area and generating an end stop signal, wherein the measurement system further comprises a microprocessor and an alpha-numeric display device, wherein the microprocessor receives the end stop signal from the rotary encoder, wherein the microprocessor determines the distance from the end stop to the working area thereby computing the material length, wherein the microprocessor outputs a length signal corresponding to the material length, wherein the alpha-numeric display device receives the length signal from the microprocessor and provides an alpha-numeric representation of the material length.

Additional understanding of the devices and methods contemplated and/or claimed by the inventor(s) can be gained by reviewing the detailed description of exemplary devices and methods, presented below, and the referenced drawings.

Any suitable structure and/or material can be used for the components of an exemplary extension table assembly, and a skilled artisan will be able to select an appropriate structure and material for the components in a particular exemplary extension table assembly based on various considerations, including the intended use of the extension table assembly, the intended arena within which the extension table assembly will be used, and the equipment and/or accessories with which the extension table assembly is intended to be used, among other considerations. For instance, the components of the extension table assembly could be made from aluminum or another metal, plastic (e.g., nylon, polyoxymethylene, fiberglass reinforced plastic, and the like. Further, arm portion and extension arm portion (if present) could be manufactured through any commonly used manufacturing method, including, but not limited to extruding and pultruding.

It is noted that all structure and features of the various described and illustrated exemplary extension table assemblies can be combined in any suitable configuration for inclusion in an extension table assembly according to a particular embodiment.

It is noted that all structure and features of the various described and illustrated embodiments can be combined in any suitable configuration for inclusion in an extension table assembly according to a particular embodiment. For example, an extension table assembly according a particular embodiment can include neither, one, or both of the arm portion and the extension arm portion described above. Furthermore, an extension table assembly according to a particular embodiment can include either the measurement system and the drive system described above in combination with neither, one, or both of the measurement system and drive system described above.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. An extension table assembly for a power tool, said extension table assembly configured for operation on an operational surface, said power tool having a working surface for supporting a piece of material to be modified, said power tool having a working area where the power tool can modify a piece of material, said extension table assembly comprising:

a frame portion for supporting the power tool above said operational surface, an arm portion, an extension arm portion, at least one drive system, and a measurement system, wherein:

said frame portion comprising at least one power tool mount, said power tool mount configured for mounting said power tool there-on, said frame portion comprising at least one connector for connecting said frame portion to said arm portion, said arm portion comprising a distal end and a proximal end defining an arm portion length therebetween, wherein said proximal end connects with said frame portion at said connector, said arm portion further comprising a support surface for supporting said piece of material to be modified, said support surface generally planar to said working surface, said extension arm portion having a first end opposite a second end defining an extension arm portion length therebetween, said first end attaching to said distal end via an arm connector, said drive system comprising a movable carriage and a shuttle having an end stop, and said measurement system for computing the distance between the end stop and the working area to determine a material length, wherein said arm connector comprises a hinge portion for hingedly connecting said extension arm portion to said arm portion.

2. The extension table assembly of claim 1, wherein said power tool mount is fixed in location relative to the frame portion, and wherein said power tool mount is fixed in place relative to said arm portion.

3. The extension table assembly of claim 2, wherein said frame portion comprises a first side opposite a second side, wherein said connector attaches said arm portion to said frame portion so that said arm portion generally extends away from said first side.

4. The extension table assembly of claim 1, wherein said frame portion comprises at least one surface support for supporting said frame portion above said operational surface, wherein said surface support comprises a plurality of legs, wherein said legs are configured for extending between an extended position and a retracted position, and wherein said surface support comprises at least one wheel configured for contacting said operational surface when said legs are in said retracted position.

5. The extension table assembly of claim 1, wherein a first guide channel is defined along said arm portion length, said first guide channel comprising a rail, said movable carriage configured for moving along said rail.

6. The extension table assembly of claim 1, wherein a first guide channel is defined along said arm portion length, said first guide channel comprising a rail, said movable carriage configured for moving along said rail, wherein a second guide channel is defined along said extension arm portion length, said second guide channel comprising a second rail, said movable carriage configured for moving along said second rail, said second guide channel aligned with said first guide channel when said arm portion and said extension arm portion are in their use position.

7. The extension table assembly of claim 4, wherein said extension arm portion further comprises a second surface support for supporting said extension arm portion above said operational surface.

8. The extension table assembly of claim 7, wherein said second surface support comprises a plurality of legs, wherein said legs are configured for extending between an extended position and a retracted position.

9. The extension table assembly of claim 1, wherein said arm portion and said extension arm portion have a use position and a stowed position, wherein said arm portion comprises an underside surface and said extension arm portion comprises an underside surface, wherein in said stowed position said arm portion and said extension arm portion are folded together so that said underside surfaces face one another.

10. The extension table assembly of claim 6, wherein said drive system further comprises a drive for reciprocatingly moving said movable carriage along said rail and said second rail.

11. The extension table assembly of claim 1, wherein said extension arm portion further comprising a second support surface for supporting said piece of material to be modified, said second support surface generally planar to said support surface when said arm portion and said extension arm portion are in their use position.

12. The extension table assembly of claim 1, wherein said measurement system comprises a sensor for sensing the relative position of said end stop relative to said working area and generating an end stop signal.

13. The extension table assembly of claim 12, wherein said measurement system further comprises a microprocessor and an alpha-numeric display device, wherein said microprocessor receives said end stop signal from said sensor, wherein said microprocessor determines the distance from said end stop to said working area thereby computing said material length, wherein said microprocessor outputs a length signal corresponding to said material length, wherein said alpha-numeric display device receives said length signal from said microprocessor and provides an alpha-numeric representation of said material length.

14. The extension table assembly of claim 1, wherein said drive system further comprises a drive for driving said movable carriage.

15. The extension table assembly of claim 14, wherein a first guide channel is defined along said arm portion length, said first guide channel comprising a rail, said movable carriage configured for moving along said rail, wherein said drive drives said movable carriage along said rail.

16. The extension table assembly of claim 14, wherein said drive comprises: a drive pulley on a drive shaft, a second pulley on a second shaft, a hand-wheel for turning said drive shaft, and a belt extending between said drive pulley and said second pulley, wherein said movable carriage is attached to said belt, wherein rotation of the hand-wheel in a first direction causes the movable carriage to advance along said rail in a first direction, and wherein rotation of the hand-wheel in a second direction causes the movable carriage to advance along said rail in a second direction.

17. The extension table assembly of claim 16, wherein said drive further comprises a lock for preventing rotation of the drive shaft thereby locking the movable carriage in place.

18. An extension table assembly for a power tool, said extension table assembly configured for operation on an operational surface, said power tool having a working surface for supporting a piece of material to be modified, said power tool having working area where the power tool can modify a piece of material, said extension table assembly comprising:

a frame portion for supporting the power tool above said operational surface, an arm portion, an extension arm portion, at least one drive system, and a measurement system, wherein:

said frame portion comprising at least one power tool mount, said power tool mount configured for mounting said power tool there-on, said frame portion comprising at least one connector for connecting said frame portion to said arm portion, said arm portion comprising a distal end and a proximal end defining an arm portion length therebetween, wherein said proximal end connects with said frame portion at said connector, said arm portion further comprising a support surface for supporting said piece of material to be modified, said support surface generally planar to said working surface, said extension arm portion having a first end opposite a second end defining an extension arm portion length therebetween, said first end attaching to said distal end via an arm connector, said drive system comprising a movable carriage and a shuttle having an end stop, wherein said drive system further comprises a drive for driving said movable carriage along said rail, and said measurement system comprises a sensor for sensing the relative position of said end stop relative to said working area and generating an end stop signal, wherein said measurement system further comprises a microprocessor and an alpha-numeric display device, wherein said microprocessor receives said end stop signal from said sensor, wherein said microprocessor determines the distance from said end stop to said working area thereby computing said material length, wherein said microprocessor outputs a length signal corresponding to said material length, wherein said alpha-numeric display device receives said length signal from said microprocessor and provides an alpha-numeric representation of said material length, wherein said arm connector comprises a hinge portion for hingedly connecting said extension arm portion to said arm portion.

19. The extension table assembly of claim 18, said extension arm portion further comprises a second surface support for supporting said extension arm portion above said operational surface, said second surface support comprising a plurality of legs, wherein said legs are configured for extending between an extended position and a retracted position, wherein a second guide channel is defined along said extension arm portion length, said second guide channel comprising a second rail, said movable carriage configured for moving along said second rail, said second guide channel aligned with said first guide channel when said arm portion and said extension arm portion are in their use position, wherein said extension arm portion further comprising a second support surface for supporting said piece of material to be modified, said second support surface generally planar to said support surface when said arm portion and said extension arm portion are in their use position, and said arm portion and said extension arm portion have a use position and a stowed position, wherein said arm portion comprises an underside surface and said extension arm portion comprises an underside surface, wherein in said stowed position said arm portion and said extension arm portion are folded together so that said underside surfaces face one another.

20. An extension table assembly for a power tool, said extension table assembly configured for operation on an operational surface, said power tool having a working surface for supporting a piece of material to be modified, said power tool having working area where the power tool can modify a piece of material, said extension table assembly comprising:

a frame portion for supporting the power tool above said operational surface, an arm portion, an extension arm portion, at least one drive system, and a measurement system, wherein:

said frame portion comprising at least one power tool mount, said power tool mount configured for mounting said power tool there-on, said frame portion comprising at least one surface support for supporting said frame portion above said operational surface, said frame portion comprising at least one connector for connecting said frame portion to said arm portion; and said arm portion comprising a distal end and a proximal end defining an arm portion length therebetween, wherein said proximal end connects with said frame portion at said connector, said arm portion further comprising a support surface for supporting said piece of material to be modified, said support surface generally planar to said working surface, wherein a first guide channel is defined along said arm portion length, said first guide channel comprising a first rail, said movable carriage configured for moving along said first rail, said extension arm portion having a first end opposite a second end defining an extension arm portion length therebetween, said first end attaching to said distal end via an arm connector, said extension arm portion further comprises a second surface support for supporting said extension arm portion above said operational surface, said second surface support comprising a plurality of legs, wherein said legs are configured for extending between an extended position and a retracted position, wherein a second guide channel is defined along said extension arm portion length, said second guide channel comprising a second rail, said movable carriage configured for moving along said second rail, said second guide channel aligned with said first guide channel when said arm portion and said extension arm portion are in their use position, wherein said extension arm portion further comprising a second support surface for supporting said piece of material to be modified, said second support surface generally planar to said support surface when said arm portion and said extension arm portion are in their use position, said arm portion and said extension arm portion have a use position and a stowed position, wherein said arm connector comprises a hinge portion for hingedly connecting said extension arm portion to said arm portion, wherein said arm portion and said extension arm portion each comprises an underside surface, wherein in said stowed position said arm portion and said extension arm portion are folded together so that said underside surfaces face one another, said drive system comprising a movable carriage having an end stop, wherein said drive system further comprises a drive for driving said movable carriage along rail, wherein said drive comprises: a drive pulley on a drive shaft, a second pulley on a second shaft, a hand-wheel for turning said drive shaft, and a belt extending between said drive pulley and said second pulley, wherein said movable carriage is attached to said belt, wherein rotation of the hand-wheel in a first direction causes the movable carriage to advance along said rail in a first direction, and wherein rotation of the hand-wheel in a second direction causes the movable carriage to advance along said rail in a second direction, and said measurement system comprises a rotary encoder on said drive shaft, said rotary encoder for sensing the relative position of said end stop relative to said working area and generating an end stop signal, wherein said measurement system further comprises a microprocessor and an alpha-numeric display device, wherein said microprocessor receives said end stop signal from said rotary encoder, wherein said microprocessor determines the distance from said end stop to said working area thereby computing said material length, wherein said microprocessor outputs a length signal corresponding to said material length, wherein said alpha-numeric display device receives said length signal from said microprocessor and provides an alpha-numeric representation of said material length.

* * * * *